US008025017B2

(12) United States Patent
Niizeki et al.

(10) Patent No.: US 8,025,017 B2
(45) Date of Patent: Sep. 27, 2011

(54) THREAD CUTTER FOR SEWING MACHINE

(75) Inventors: Tomoyasu Niizeki, Inazawa (JP); Yoko Totsu, Sendai (JP); Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 442 days.

(21) Appl. No.: 12/320,768

(22) Filed: Feb. 4, 2009

(65) Prior Publication Data

US 2009/0199754 A1 Aug. 13, 2009

(30) Foreign Application Priority Data

Feb. 7, 2008 (JP) ..... 2008-027686

(51) Int. Cl.
*D05B 65/00* (2006.01)
*D05B 65/02* (2006.01)

(52) U.S. Cl. ..... 112/291

(58) Field of Classification Search ..... 112/285–298; 83/910

See application file for complete search history.

(56) References Cited

U.S. PATENT DOCUMENTS

| | | | | |
|---|---|---|---|---|
| 5,065,683 | A | 11/1991 | Hayashi | |
| 6,276,289 | B1 * | 8/2001 | Wahlstrom | 112/292 |
| 6,725,794 | B2 | 4/2004 | Usa | |
| 7,357,089 | B1 * | 4/2008 | Chang | 112/285 |
| 7,497,177 | B2 * | 3/2009 | Tanaka et al. | 112/292 |
| 2008/0229989 | A1 * | 9/2008 | Shiraishi | 112/300 |
| 2008/0250995 | A1 | 10/2008 | Hanada | |
| 2009/0211505 | A1 * | 8/2009 | Hanada | 112/292 |

FOREIGN PATENT DOCUMENTS

| | | |
|---|---|---|
| JP | A-3-109095 | 5/1991 |
| JP | A-3-210298 | 9/1991 |
| JP | U-5-51262 | 7/1993 |
| JP | A-2003-284878 | 10/2003 |
| JP | A-2006-87811 | 4/2006 |

* cited by examiner

*Primary Examiner* — Ismael Izaguirre
(74) *Attorney, Agent, or Firm* — Oliff & Berridge, PLC

(57) ABSTRACT

A thread cutter for a sewing machine includes a first thread seizing assembly reciprocally movable and including two unit thread seizing members having distal ends formed with first thread seizing portions respectively, a cutting blade located nearer to the needle hole side than a movement locus of the first assembly, and a second thread seizing assembly seizing the needle and bobbin threads both seized by the first assembly during backward movement of the first assembly, cutting the threads in cooperation with the cutting blade. When the threads seized by the first assembly are further seized by the second assembly, the first assembly is moved so that the distal ends of the unit thread seizing members are spaced from each other by a predetermined distance in a direction intersecting a movement direction of the first assembly.

11 Claims, 31 Drawing Sheets

FIG. 20A
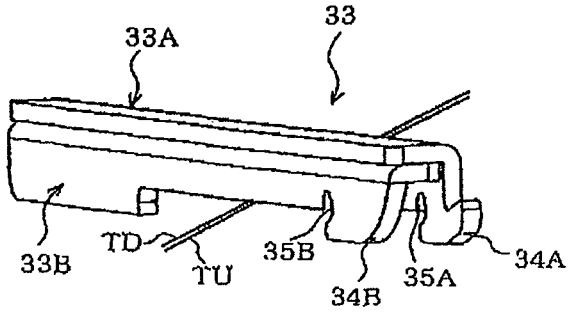
FIG. 20B
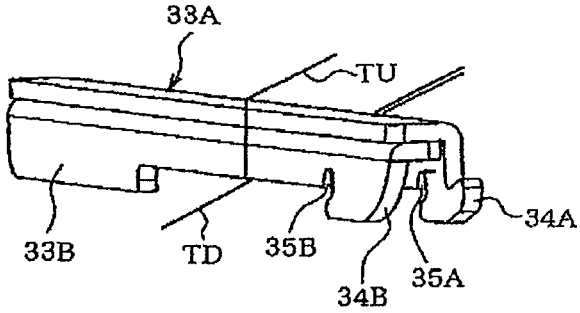
FIG. 20C
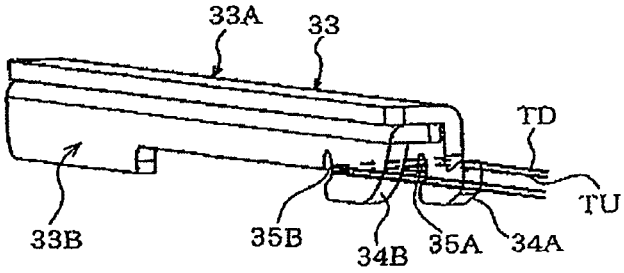
(d)
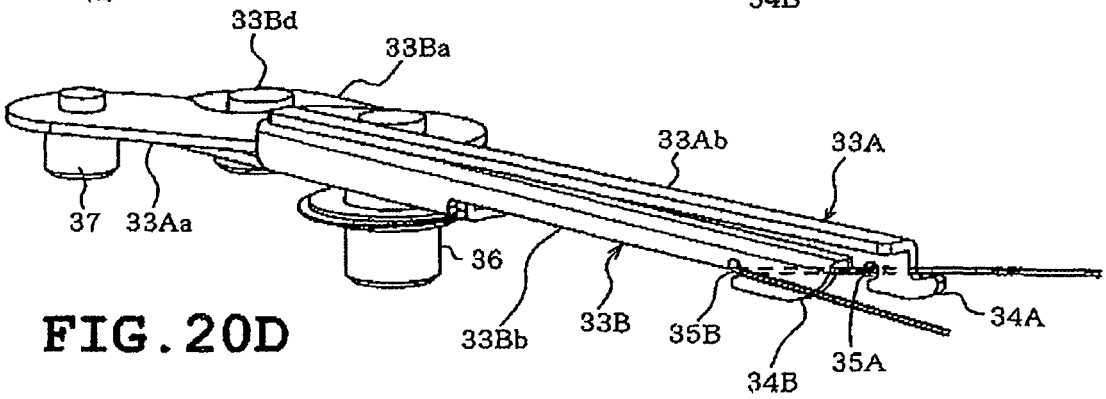
FIG. 20D

THREAD CUTTER FOR SEWING MACHINE

CROSS-REFERENCE TO RELATED APPLICATIONS

This application is based upon and claims the benefit of priority from the prior Japanese Patent Application No. 2008-27686, filed on Feb. 7, 2008, the entire contents of which are incorporated herein by reference.

BACKGROUND

1. Technical Field

The present disclosure relates to a thread cutter for a sewing machine, which is provided on an underside of a needle plate having a needle hole and cuts needle and bobbin threads located between a workpiece cloth and a rotary hook including an outer rotating hook and an inner bobbin case.

2. Description of the Related Art

Conventional sewing machines have been provided with thread cutters. The thread cutter is provided on an underside of a needle plate having a needle hole and cuts needle and bobbin threads located between a workpiece cloth and a rotary hook including an outer rotating hook and an inner bobbin case. For example, Japanese patent application publication JP-A-H03-210298 (hereinafter referred to as "related art document 1") discloses a thread cutter of the above-described type, in which a thread cutting cam mounted on a lower shaft of a sewing machine is actuated by a sewing machine motor so that a moving blade is driven. The moving blade and a fixed blade are caused to cooperate with each other thereby to cut needle and bobbin threads. The thread cutter disclosed by related art document 1 is provided with the moving and fixed blades as a cutting blade, and the moving blade is driven by the sewing machine motor to be caused to cooperate with the fixed blade. As a result, the thread cutter has a complicated construction.

In order to overcome the complicated construction, Japanese patent application publication JP-2003-284878 (hereinafter referred to as "related art document 2") discloses another thread cutter for a sewing machine. The thread cutter disclosed by related art document 2 includes a stepping motor serving as a dedicated drive source for driving a thread seizing assembly. The thread cutter further includes a fixed blade as a cutting blade. The thread seizing assembly has a distal end which is reciprocally moved above a bobbin case thereby to seize the needle and bobbin threads. The seized needle and bobbin threads are cut by the fixed blade mounted on a proximal end side of the thread seizing assembly.

The thread cutter disclosed by related art document 2 has a simple construction since the thread seizing assembly is driven by the stepping motor. However, the needle and bobbin threads are cut by the fixed blade mounted on the proximal end side of the thread seizing assembly. Accordingly, the location of the fixed blade is spaced farther away from the needle hole of the needle plate than in the thread cutter of related art document 1. As a result, an amount of needle and bobbin threads remaining at the workpiece cloth side after thread cutting (remaining amounts of threads at the workpiece cloth side) is increased disadvantageously. Furthermore, the thread cutter of related art document 2 has another disadvantage that an amount of needle thread remaining in a section from an eye of a needle attached to a needlebar to a thread end (a remaining amount of thread at the needle side) also becomes larger than a proper amount necessitated for stitch forming in a subsequent sewing operation. When an extra amount of threads remains at the workpiece cloth and needle sides, there is a possibility of occurrence of failure or trouble such as thread entanglement in an initial stitch upon start of a subsequent sewing operation. Additionally, the extra thread ends need to be manually cut after completion of the sewing operation.

SUMMARY

Therefore, an object of the present disclosure is to provide a thread cutter for a sewing machine which can render the remaining amount of threads smaller.

The present disclosure provides a thread cutter for a sewing machine, which is provided on an underside of a needle plate having a needle hole and cuts a needle thread and a bobbin thread both located between a workpiece cloth and a rotary hook including an outer rotating hook and an inner bobbin case. The thread cutter comprises a first thread seizing assembly which is supported so as to be reciprocally movable and includes two unit thread seizing members having distal ends provided with first thread seizing portions respectively, the first thread seizing assembly seizing the needle thread having passed the bobbin case and a bobbin thread by the first thread seizing portions, the bobbin case housing a bobbin on which a bobbin thread is wound, the bobbin thread extending from the bobbin to the needle hole of the needle plate; a cutting blade located nearer to the needle hole side than a movement locus of the first thread seizing assembly; a second thread seizing assembly which seizes the needle and bobbin threads both having been seized by the first thread seizing assembly during a backward movement of reciprocation of the first thread seizing assembly, cutting the needle and bobbin threads in cooperation with the cutting blade; and a drive unit which drives the first and second thread seizing assemblies. When the needle and bobbin threads having been seized by the first thread seizing assembly are further seized by the second thread seizing assembly, the first thread seizing assembly is moved so that the distal ends of the unit thread seizing members are spaced from each other by a predetermined distance in a direction intersecting a movement direction of the first thread seizing assembly.

According to the above-described construction, the cutting blade is located nearer to the needle hole side than the movement locus of the first thread seizing assembly. The needle and bobbin threads seized by the first seizing member are further seized by the second thread seizing assembly during the backward movement of reciprocation of the first thread seizing assembly. The second thread seizing assembly cooperates with the cutting blade to cut the needle and bobbin threads at the location nearer to the needle hole than the movement locus of the first thread seizing assembly. Consequently, a remaining amount of threads can be rendered smaller as compared with the construction disclosed by related art document 2. Accordingly, occurrence of failure or trouble such as thread entanglement can be prevented in the forming of an initial stitch upon start of a subsequent sewing operation, and an extra amount of threads to be cut can be reduced.

When the needle and bobbin threads seized by the first thread seizing assembly are further seized by the second thread seizing assembly, the distal ends of the unit thread seizing members are moved so as to be spaced from each other by the predetermined distance in the direction intersecting the movement direction of the first thread seizing assembly. Accordingly, the needle and bobbin threads at the workpiece cloth side can be seized in the state where a distance is increased between a thread-seizing part of the first thread seizing portion of the unit thread seizing member and a thread-seizing part of the first thread seizing portion of the other unit thread seizing member of the first thread seizing assembly. Consequently, the threads can be seized by the second thread seizing assembly easily and reliably.

BRIEF DESCRIPTION OF THE DRAWINGS

Other objects, features and advantages of the present disclosure will become clear upon reviewing the following description of the embodiment with reference to the accompanying drawings, in which:

FIGS. 9A and 9B to 18A and 18B are plan and side views of the thread cutter and the horizontal rotary hook respectively, explaining the operations of the thread cutter and the horizontal rotary hook in different operation stages (Nos. 1 to 10);

FIGS. 20A, 20B and 20C show a manner of seizing the threads by the first thread seizing assembly in sequential operation stages (Nos. 1 to 3);

FIG. 20D shows one of unit thread seizing members in a swinging state;

DETAILED DESCRIPTION

Figure 1:
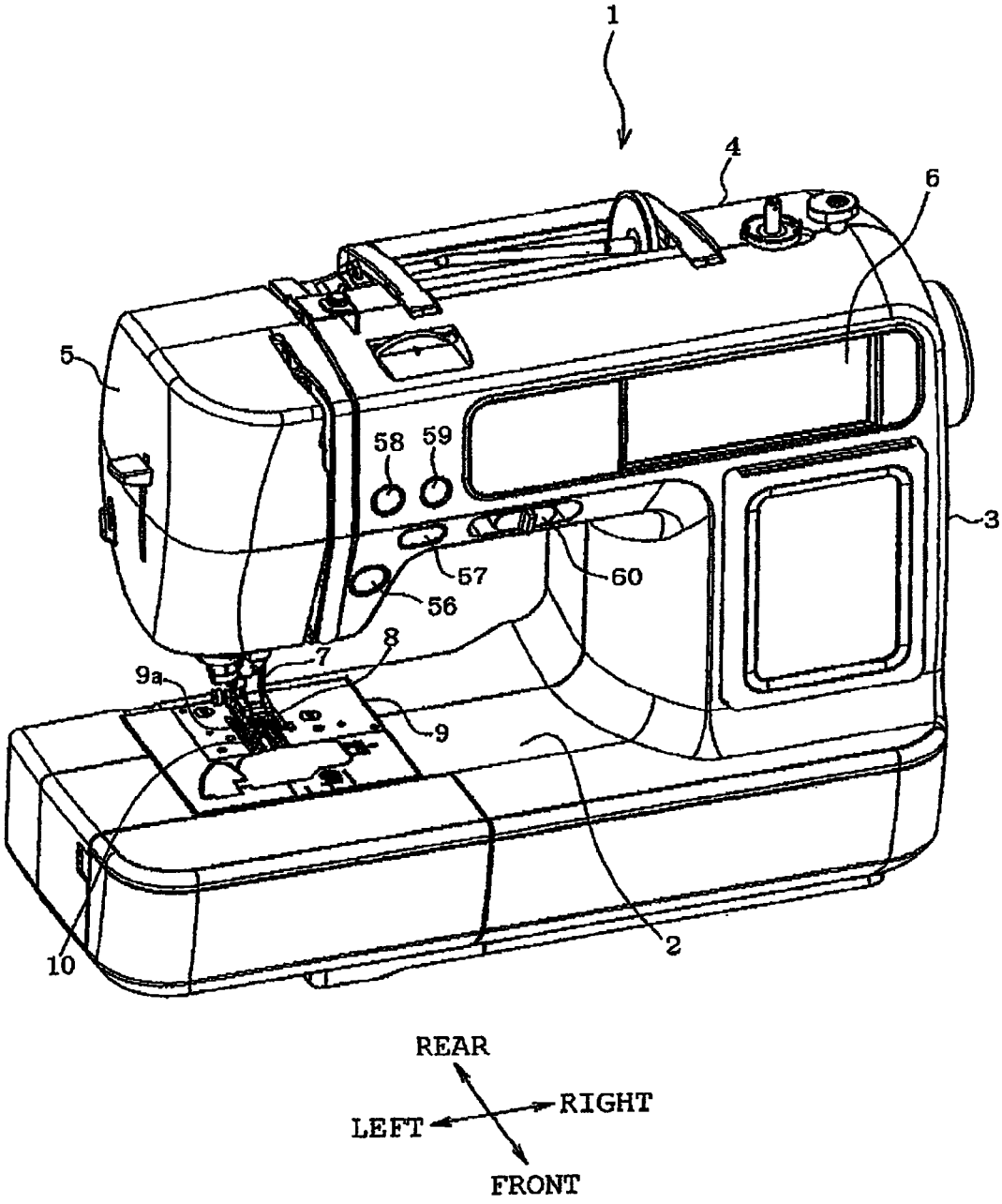
FIG. 1 is a perspective view of a sewing machine to which a thread cutter of a first example is applied.

A first embodiment will now be described with reference to FIGS. 1 to 21F. Referring to FIG. 1, a sewing machine to which a thread cutter of the embodiment is applied is shown. The sewing machine 1 includes a bed 2 having a horizontal surface, a pillar 3 extending upward from a right end of the bed 2, and an arm 4 extending leftward from an upper end of the pillar 3 and a head provided on a left end of the arm 4. A side of the sewing machine where the operator is located refers to the front of the sewing machine 1, and the opposite side refers to a rear of the sewing machine 1. Another side of the sewing machine where the pillar 3 is located refers to a right side of the sewing machine 1, and the opposite side refers to a left side of the sewing machine 1.

In the head 5 are provided a needlebar driving mechanism, a presser foot lifting mechanism, a needle thread take-up driving mechanism, a threading mechanism and the like although none of them are shown. The needlebar driving mechanism vertically drives a needlebar (not shown) to which a needle 7 is attached. The presser foot lifting mechanism vertically lifts a presser foot 8. The needle threads take-up driving mechanism drives a needle thread take-up (not shown) drawing a needle thread upward from the needle 7 side in synchronization with the needlebar. The threading mechanism causes the needle thread to pass through an eye (not shown) of the needle.

A liquid-crystal display 6 with a touch panel is mounted on a front surface of the arm 4. A pattern to be sewn is displayed on the liquid-crystal display 6. The operator can select a desired-pattern on the liquid-crystal display 6. Furthermore, on the front surface of the arm 4 are provided a sewing start/stop switch 56 for starting and stopping a sewing operation, a reverse stitching switch 57 for feeding a workpiece cloth from the rear to the front, a needle position change-over switch 58 for changing over a stop position of the needlebar between a needle upper position and a needle lower position, a thread cutting switch 59 which is operated so that a thread cutting operation is carried out, and a speed adjusting knob 60 for adjusting a sewing speed. The needlebar is designed to be normally stopped at the needle lower position upon stop of a sewing operation, that is, to be normally stopped while the needle 7 is stuck into the workpiece cloth.

Figure 2:
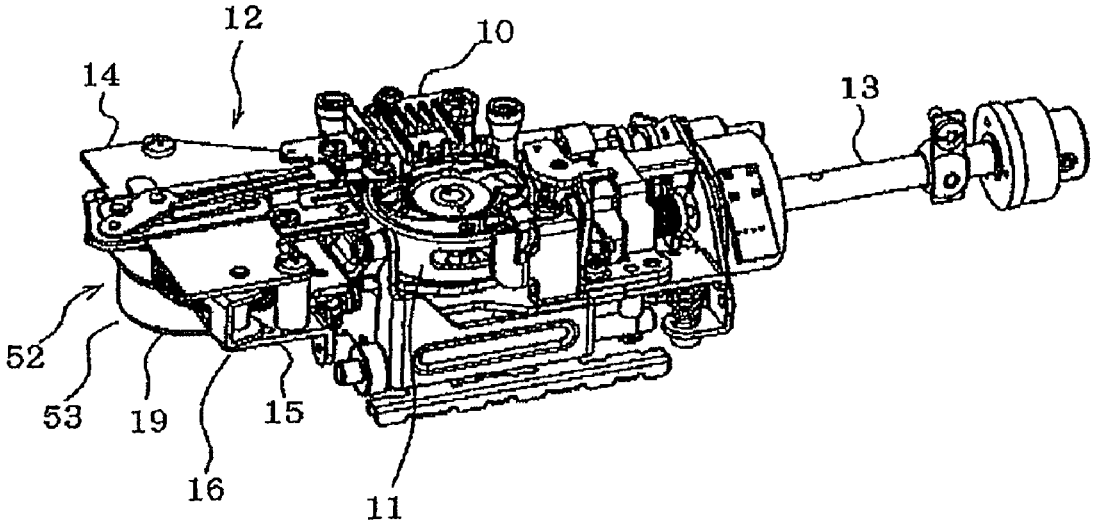
FIG. 2 is a perspective view of a mechanism in a bed.

A needle plate 9 is mounted on the bed 2 and has a needle hole 9*a* (see FIG. 3A) which allows the vertically moved needle 7 to pass therethrough. On the back of the needle plate 9 are provided a feed mechanism (not shown) driving a feed dog 10 in forward and rearward directions and in vertical directions, a horizontal rotary hook 11 (see FIG. 2), a thread cutter (see FIG. 2) and the like. The horizontal rotary hook 11 includes an outer rotating hook 11*a* and an inner bobbin case 11*b* which is housed inside the rotating hook 11*a* and unrotatably locked by a bobbin case locking member (not shown). A bobbin 54 on which a bobbin thread TD is wound is housed in the bobbin case 11*b*. A lower shaft 13 directed in a right-and-left direction is provided in the bed 2 as shown in FIG. 2. The lower shaft 13 is rotatably mounted on a sewing machine frame (not shown) and rotated by a sewing machine motor (not shown). Upon rotation of the lower shaft 13, the feed mechanism is driven and the rotating hook 11*a* is rotated counterclockwise as viewed in FIG. 3A.

Figure 6A:
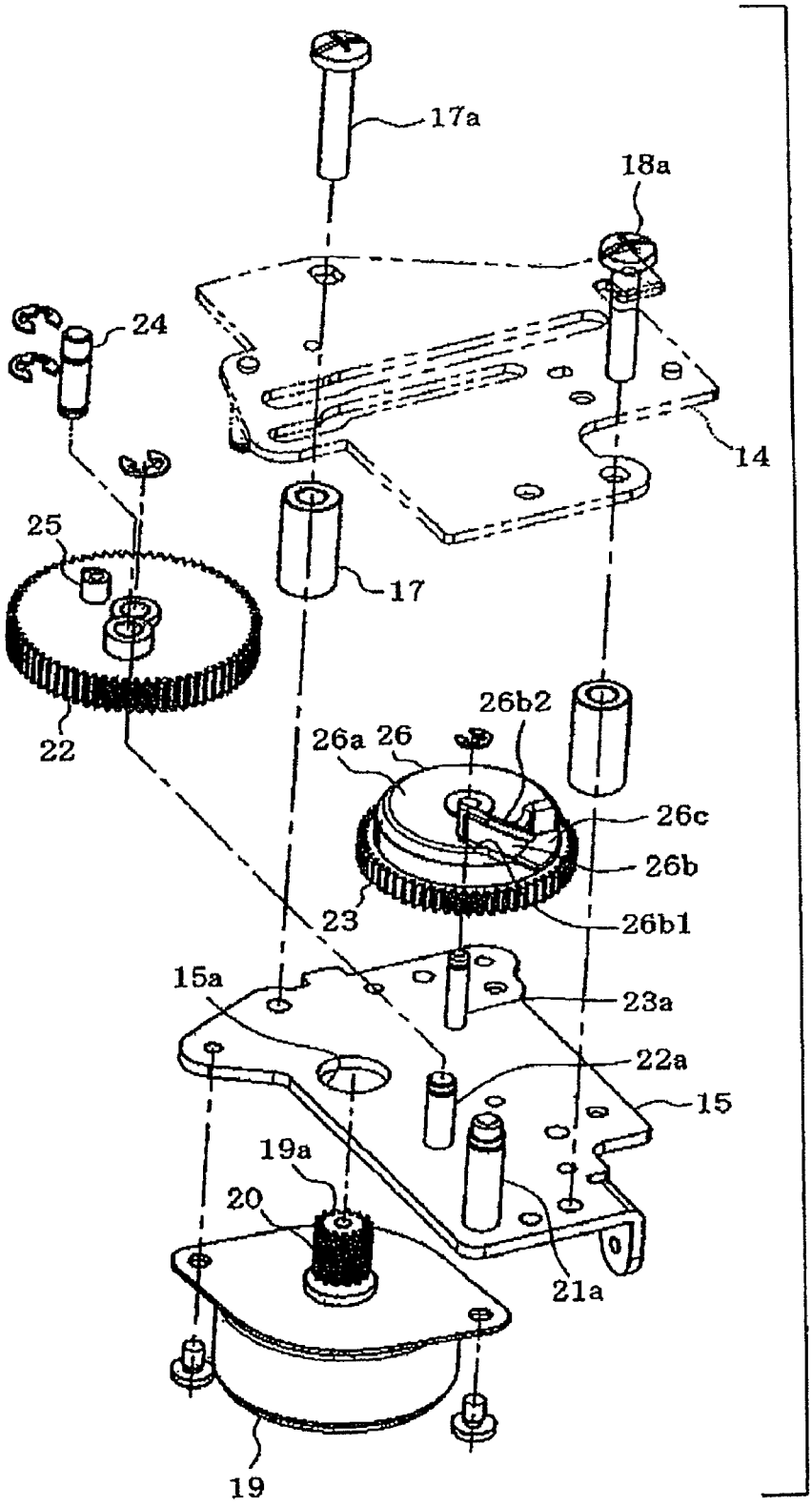
FIG. 6A is an exploded perspective view of components mounted on a base lower plate.
Figure 6B:
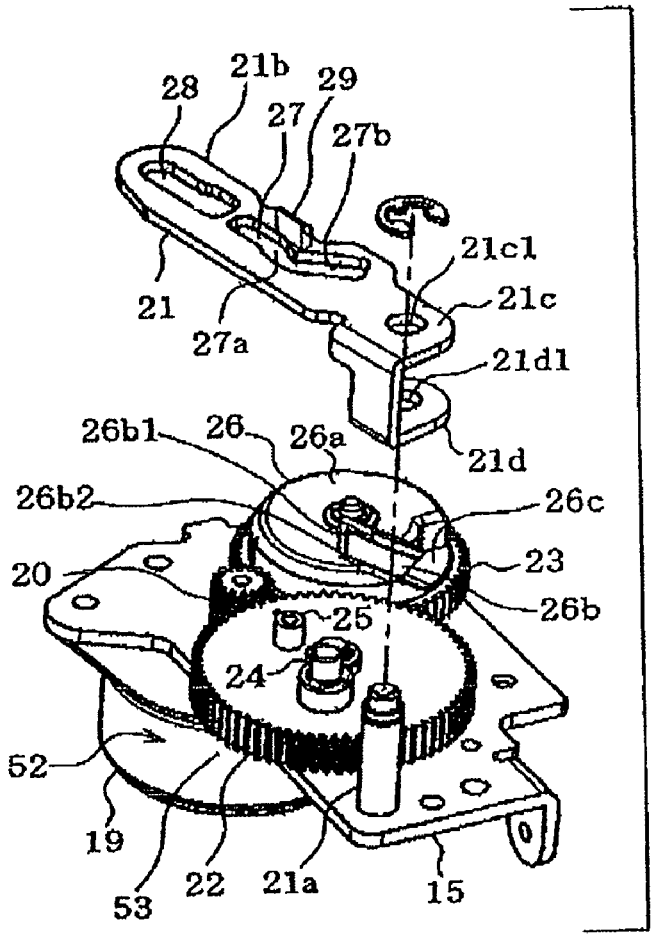
FIG. 6B is a perspective view of the components assembled onto the base lower plate before the mounting of a drive lever.
Figure 6C:
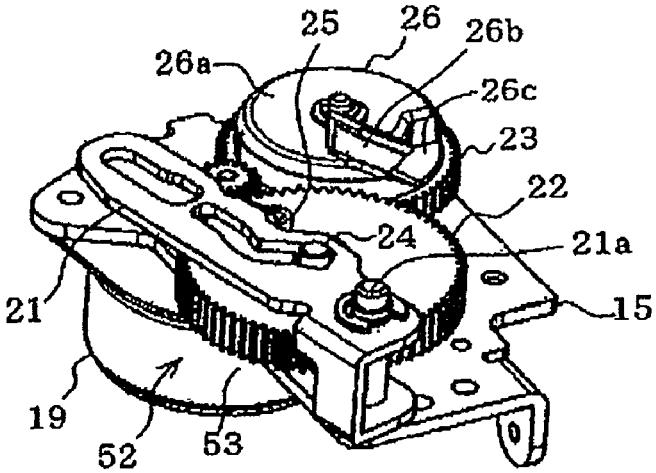
FIG. 6C is a perspective view of a completed assembly with the drive shaft having been mounted on the base lower plate.

The thread cutter 12 is provided on an underside of the needle plate 9 for cutting the needle and bobbin threads TU and TD (see FIG. 12A) located between a workpiece cloth (not shown) to be placed on the needle plate 9 and the horizontal rotary hook 11. The thread cutter 12 is formed into a unit including a base 16 further including a base upper plate 14 and a base lower plate 15. The thread cutter 12 is located just to the left of the horizontal rotary hook 11. The base 16 is formed by fixing the base upper and lower plates 14 and 15 by screws 17*a* and 18*a* with spacers 17 and 18 being interposed between the base upper and lower plates 14 and 15 as shown in FIGS. 4A, 4B, 5 and 6A to 6C. A stepping motor 19 is fixed on the underside of the base lower plate 15 by screws (not shown) as shown in FIGS. 6A to 6C. The stepping motor 19 is mounted so that a rotational shaft 19*a* thereof is directed upward. A driving gear 20 is secured to the rotational shaft 19*a* and extends through a gear insertion hole 15*a* of the base lower plate 15 so as to be located on an upper surface of the base lower plate 15.

A pin 21*a* is mounted on the upper surface of the base lower plate 15 so as to be directed upward. A drive lever 21 is supported on the pin 21*a* so as to be swingable. Another pin 22*a* is also mounted on the upper surface of the base lower plate 15 so as to be directed upward. A first driven gear 22 is rotatably supported on the pin 22*a*. Further another pin 23*a* is mounted on the upper surface of the base lower plate 15 so as to be directed upward. A second driven gear 23 is rotatably supported on the pin 23*a*. A drive pin 24 is mounted on the first driven gear 22 so as to be directed upward. A drive-lever push pin 25 is also mounted on the first driven gear 22 so as to be directed upward.

The first driven gear 22 is in mesh engagement with the driving gear 20. The second driven gear 23 is in mesh engagement with the first driven gear 22. The second driven gear 23 has a cam 26 formed on an upper portion thereof. The cam 26 includes an upper surface 26*a*, an inclined portion 26*b* and a lower surface 26*c*. The inclined portion 26*b* includes a lower inclined portion 26*b*1 and an upper eaves-shaped inclined portion 26*b*2. A distance between the lower and upper inclined portions 26*b*1 and 26*b*2 is set to be slightly longer than a diameter of a cam contact pin 40 (see FIGS. 7A and 7C) so that the cam contact pin 40 is capable of passing between the lower and upper inclined portions 26*b*1 and 26*b*2.

The drive lever 21 includes a lever body 21*b* having a distal end formed with a pair of upper and lower support strips 21*c* and 21*d* as shown in FIG. 6B. The support strips 21*c* and 21*d* have shaft insertion holes 21*c*1 and 21*d*1 respectively. The lever body 21*b* is also formed with first and second guide grooves 27 and 28 which are aligned rearward from the support strip 21*c*. The first guide groove 27 is formed so that a proximal end side groove 27*b* is curved lengthwise with respect to the drive lever 21. The first guide groove 27 has a generally arc-shaped curved portion 27*a*. A proximal end side groove 27*b* has a slightly larger width than the other portion of the first guide groove 27. The second guide groove 28 extends in the front-and-back direction and has a slightly larger width at the proximal end side than at the other portion thereof. The drive lever 21 has a push strip 29 (also see FIG. 22) drooping on a generally central right portion thereof. The push strip 29 is adapted to be pushed by the drive-lever push pin 25 as will be described later. The pin 21*a* is inserted through the shaft insertion holes 21*d*1 and 21*c*1 so that the drive lever 21 is mounted on the base lower plate 15 so as to be swingable. In this case, the drive lever 21 is located over the first driven gear 22, and an upper portion of the drive pin 24 is inserted in the first guide groove 27 so that the drive pin 24 is slidable in the first guide groove 27.

Figure 7A:
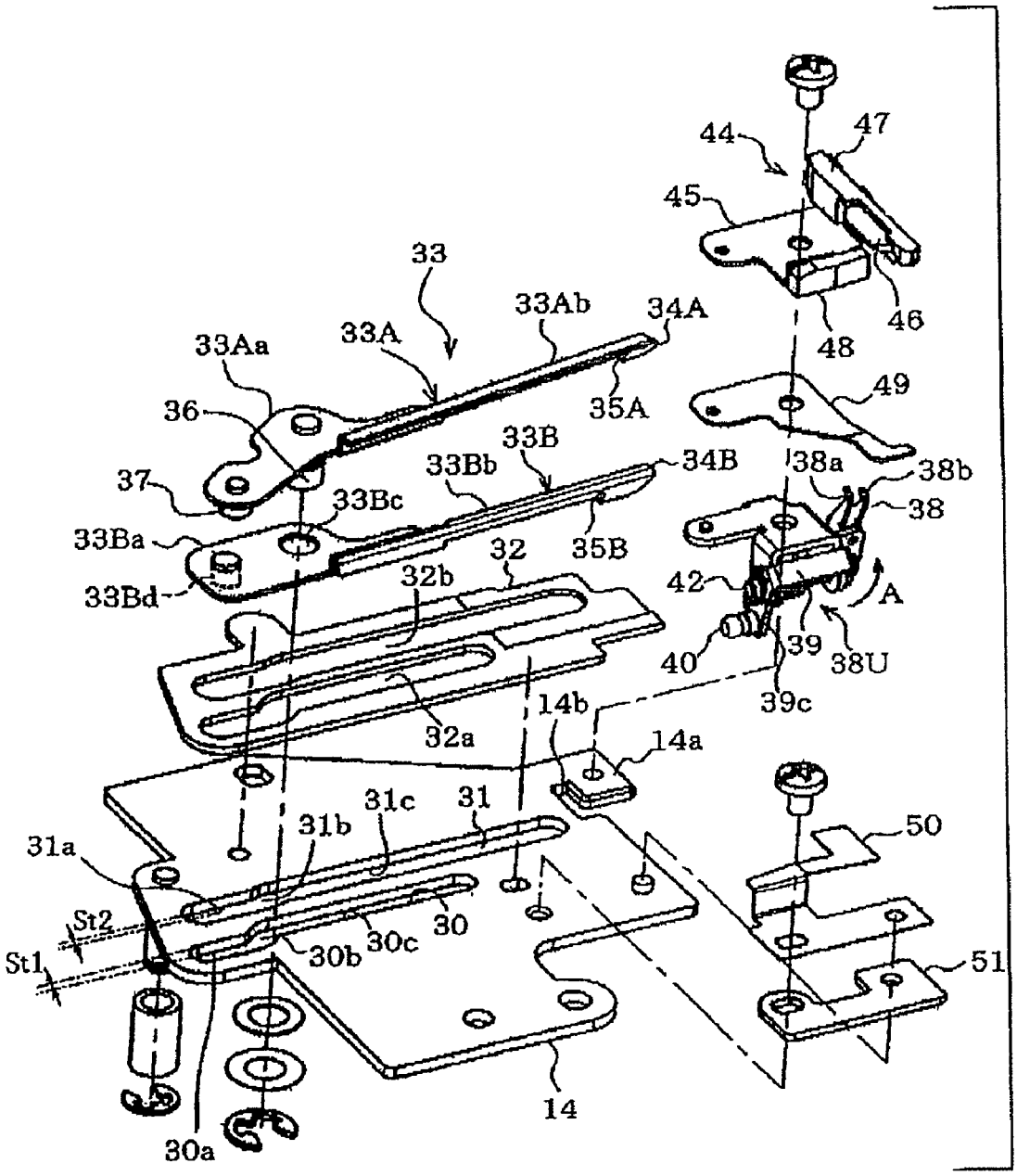
FIG. 7A is an exploded perspective view of components mounted on a base upper plate.

The base upper plate 14 is formed with a first elongated groove 30 extending in the right-and-left direction and a second elongated groove 31 located behind the first elongated groove 30 and extending in the right-and-left direction, as shown in FIG. 7A. The first elongated groove 30 includes a linear proximal end groove 30*a*, an oblique portion 30*b* and a main groove 30*c*. The proximal end groove 30*a* is formed by translating the main groove 30*c* forward by distance St (also shown in FIG. 3A). The second elongated groove 31 also includes a linear proximal end groove 31*a*, an oblique portion 31*b* and a main groove 31*c*. The proximal end groove 31*a* is formed by translating the main groove 31*c* forward by distance St2 (also shown in FIG. 3A)

A spacer 32 is mounted on a portion of the base upper plate 14 where the elongated grooves 30 and 31 are formed. The spacer 32 is provided for improving sliding in the movement of a first thread seizing assembly 33 which will be described later. The spacer 32 is formed with two elongated grooves 32*a* and 32*b* which are slightly larger than the elongated grooves 30 and 31 of the base upper plate 14 respectively. Alternatively, a single groove encompassing both elongated grooves 30 and 31 may be formed in the spacer 32, instead of the elongated grooves 32*a* and 32*b*.

A first thread seizing assembly 33 includes two unit thread seizing members 33A and 33B as shown in FIG. 7A. The construction of the unit thread seizing members 33A and 33B will be described with further reference to FIG. 20D. The unit thread seizing member 33A includes a flat plate-shaped proximal end 33Aa and an arm 33Ab extending rightward from the proximal end 33Aa. The arm 33Ab has a proximal end having a crank-shaped section. The arm 33Ab has an inverted L-shaped section extending from an intermediate portion thereof to a distal end thereof. The arm 33Ab further includes a thread-striding portion 34A formed on the distal end thereof. The thread-striding portion 34A includes a hook-shaped first thread seizing portion 35A formed on a lower portion of the distal end thereof.

The proximal end 33Aa of the unit thread seizing member 33A has an underside on which a swing shaft 36 is mounted so as to be directed downward. The swing shaft 36 is inserted through a shaft hole 33Bc of the other unit thread seizing member 33B which will be described later, an elongated groove 32*b* and the second elongated groove 31 and is slidably inserted into the second guide groove 28. Furthermore, the proximal end 33Aa includes a portion located ahead of the swing shaft 36 on the left. The portion of the proximal end 33Aa has an underside on which an auxiliary shaft 37 is mounted so as to be directed downward. The auxiliary shaft 37 is slidably inserted through the elongated groove 32*a* of the spacer 32 into the first elongated guide groove 30 of the base upper plate 14. A direction in which the swing shaft 36 and the auxiliary shaft 37 are aligned is inclined to a direction in which the arm 33Ab extends.

The other unit thread seizing member 33B includes a flat plate-shaped proximal end 33Ba and an arm 33Bb extending rightward from the proximal end 33Ba. The arm 33Bb has an inverted U-shaped section. The arm 33Bb has an inverted L-shaped section extending from an intermediate portion thereof to a distal end thereof. The arm 33Bb further includes a thread-striding portion 34B formed on the distal end thereof. The thread-striding portion 34B includes a hook-shaped first thread seizing portion 35B formed on a lower portion of the distal end thereof.

The proximal end 33Ba of the unit thread seizing member 33B is formed with a shaft hole 33Bc. The proximal end 33Ba has an underside on which a secondary shaft 33Bd is mounted. The swing shaft 36 of the unit thread seizing member 33A is rotatably fitted into the shaft hole 33Bc. Furthermore, the secondary shaft 33Bd is slidably inserted through the elongated groove 32*b* of the spacer 32 into the elongated groove 31. A direction in which the shaft hole 33Bc and the secondary shaft 33Bd are aligned is inclined to a direction in which the arm 33Bb extends.

Figure 7C:
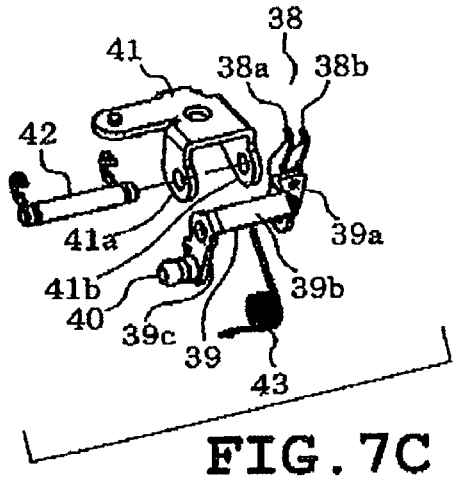
FIG. 7C is an exploded perspective view of a seizing unit.
Figure 7D:
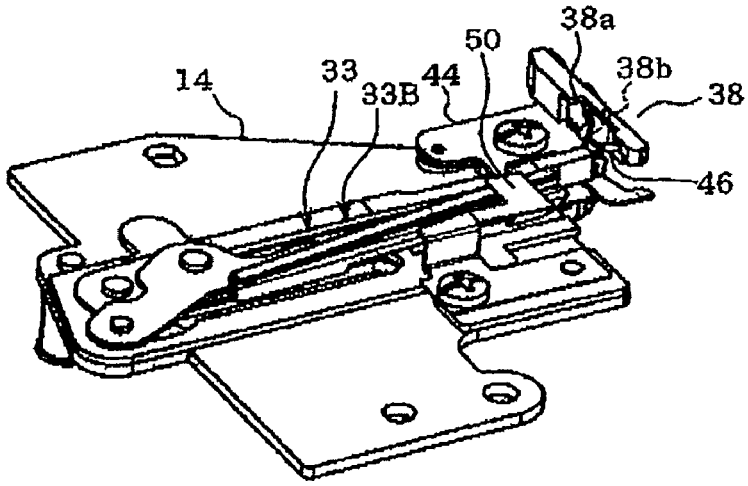
FIG. 7D is a perspective view of a completed assembly on the base upper plate.
Figure 8A:
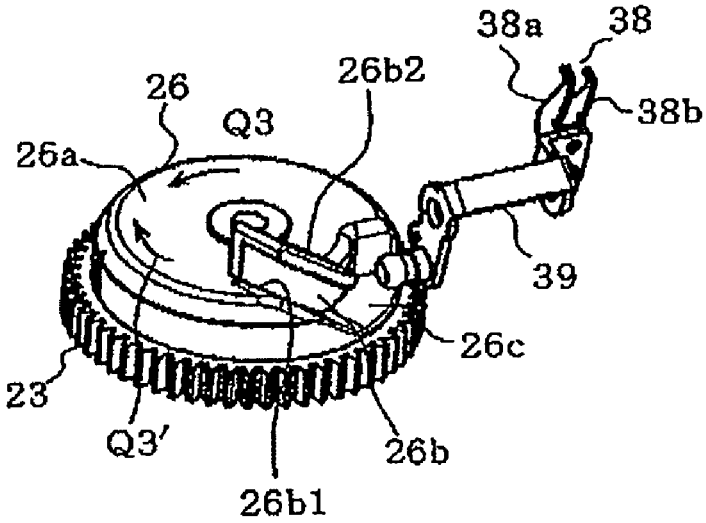
FIGS. 8A and 8B are perspective views showing the relationship among a rotational position of a cam, a cam contact pin and a second thread seizing assembly in different operation stages (Nos. 1 and 2)
Figure 8B:
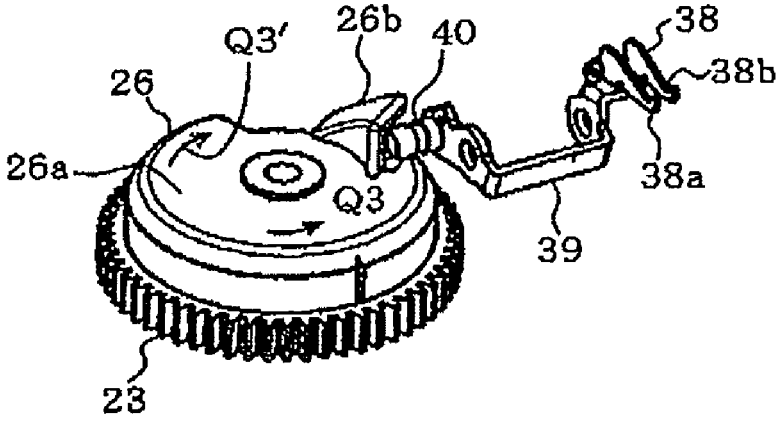

A seizing unit 38U comprises a second thread seizing assembly 38, a support 39, a cam contact pin 40, a fixture 41, a support shaft 42 and a coil spring 43. The second thread seizing assembly 38 has a distal end having two-forked hook-shaped second thread seizing portions 38*a* and 38*b*. The second thread seizing assembly 38 is mounted on the support 39. The support 39 includes a mounting portion 39*a* for mounting the second thread seizing assembly 38, a connecting strip 39*b* and a pivot arm 39*c* all of which are formed integrally, as shown in FIG. 7C. The cam contact pin 40 is secured to the pivot arm 39*c*. The support 39 is swingably mounted via a support shaft 42 to the fixture 41 having two shaft support strips 41*a* and 41*b*. A torsion coil spring 43 is provided between the support 39 and the fixture 41 to normally urge the second thread seizing assembly 38 in the direction of arrow A (see FIG. 7A). The fixture 41 is fixed to a rectangular mounting portion 14*a* formed in a right end of the base upper plate 14 by a screw together with a cutting blade unit 44 and a bobbin case presser 49 both of which will be described later. In this case, the pivot arm 39*c* of the support 39 passes through the groove 14*b* of the base upper plate 14, reaching a space under the base upper plate 14. Accordingly, the cam contact pin 40 also reaches a space below the base upper plate 14. The cam contact pin 40 can be brought into sliding contact with the cam 26 as shown in FIGS. 8A and 8B. Thus, the second thread seizing assembly 38 is swingably supported on the support shaft 42 secured to the base upper plate 14.

Figure 7B:
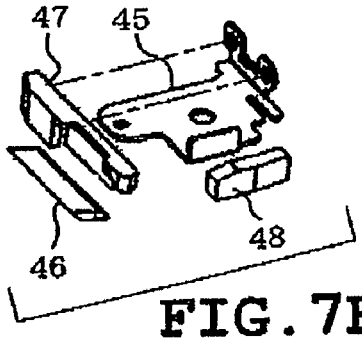
FIG. 7B is an exploded perspective view of a cutting blade unit.

The cutting blade unit 44 is provided with a unit base 45 as shown in FIGS. 7A and 7B. A cutting blade cover 47 having a cutting blade 46 is mounted to a right end of the unit base 45. The cutting blade 46 is directed forwardly obliquely downward. Furthermore, the cutting blade unit 44 has a front end to which a first piled member 48 in order that the needle and bobbin threads TU and TD cut may be held. The first piled member 48 is formed by densely transplanting short fibers with a predetermined length. The cutting blade unit 44 is screwed to the base upper plate 14 together with the bobbin case presser 49 and the fixture 41. The bobbin case presser 49 prevents an upward movement of the bobbin case 11*b* of the horizontal rotary hook 11. The cutting blade 46 is located between movement loci of the two second thread seizing portions 38*a* and 38*b*, or in other words, the cutting blade 46 is interposed between the two-forked second thread seizing portions 38*a* and 38*b*. A presser plate 50 comprising a thin leaf spring is fixed by a screw to a portion of the base upper plate 14 located in front of the first thread seizing assembly 33, with a spacer 51 being interposed therebetween. The presser plate 50 prevents the first thread seizing assembly 33 from being moved upward. A drive unit 52 driving the first and second thread seizing assemblies 33 and 38 comprises a single stepping motor 19 and a drive mechanism 53 as shown in FIG. 6C. The drive mechanism 53 includes the drive lever 21, the drive pin 24 and the cam 26 all of which are driven by the stepping motor 19.

Figure 3B:
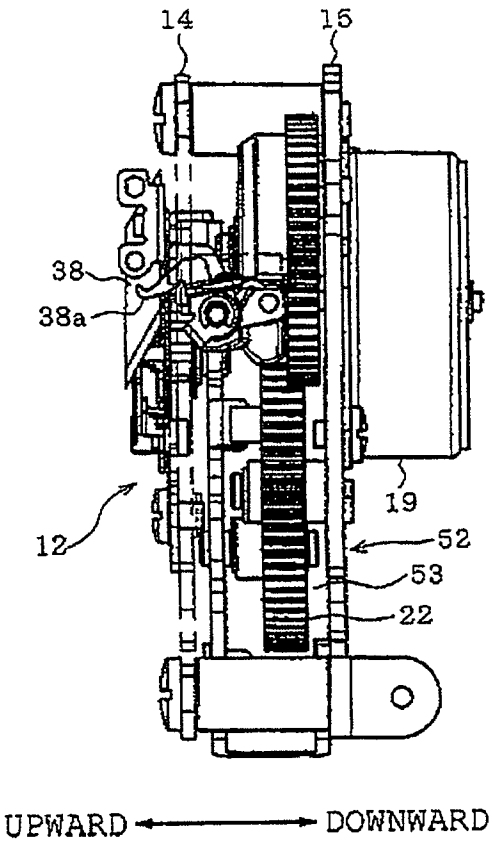
FIGS. 3A and 3B are plan and side views of a horizontal rotary hook and the thread cutter disposed under a needle plate respectively.
Figure 3A:
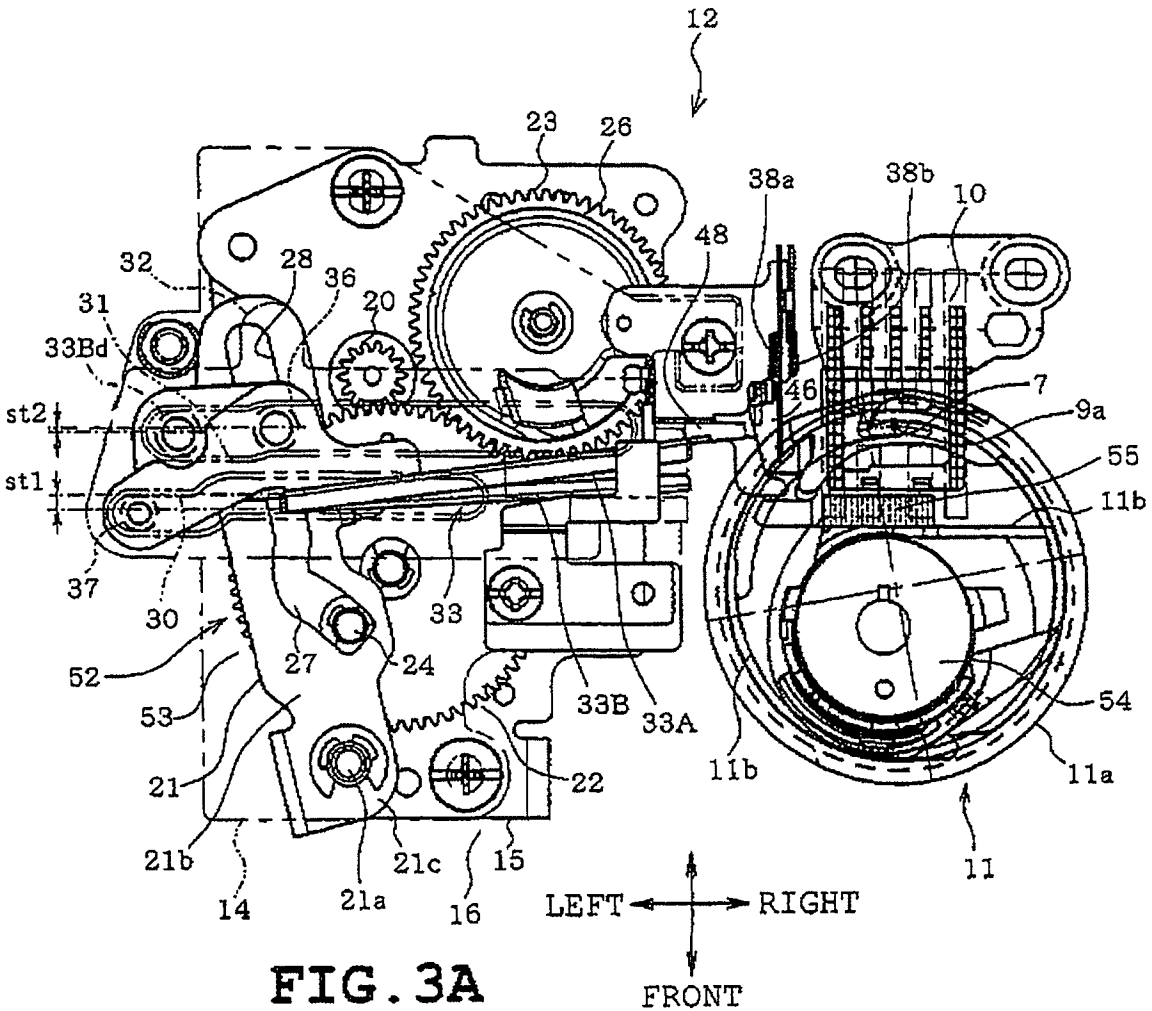
Figure 4B:
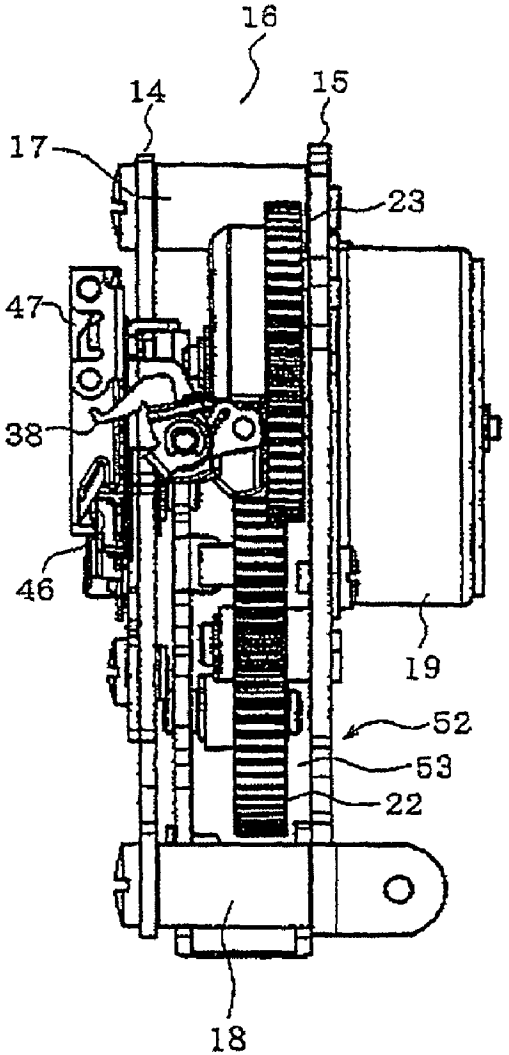
FIGS. 4A and 4B are plan and side views of the thread cutter respectively.
Figure 4A:
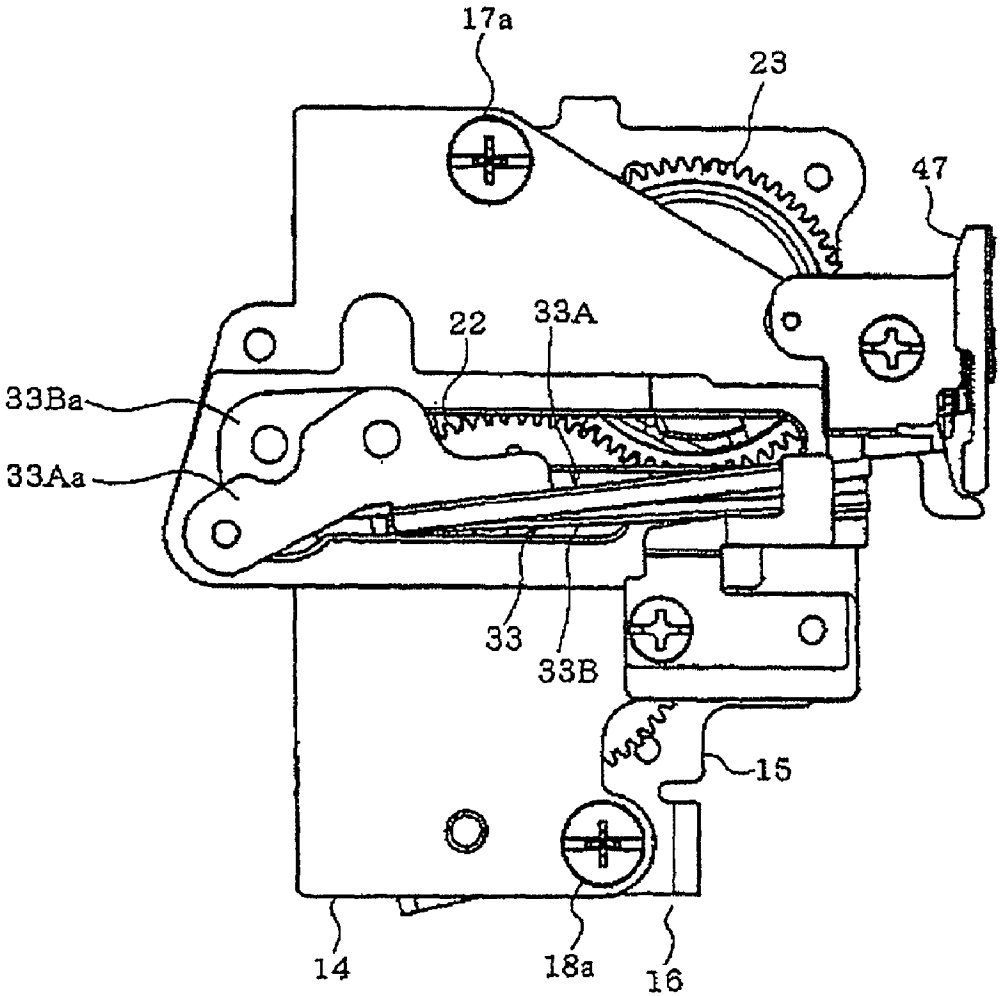
Figure 5:
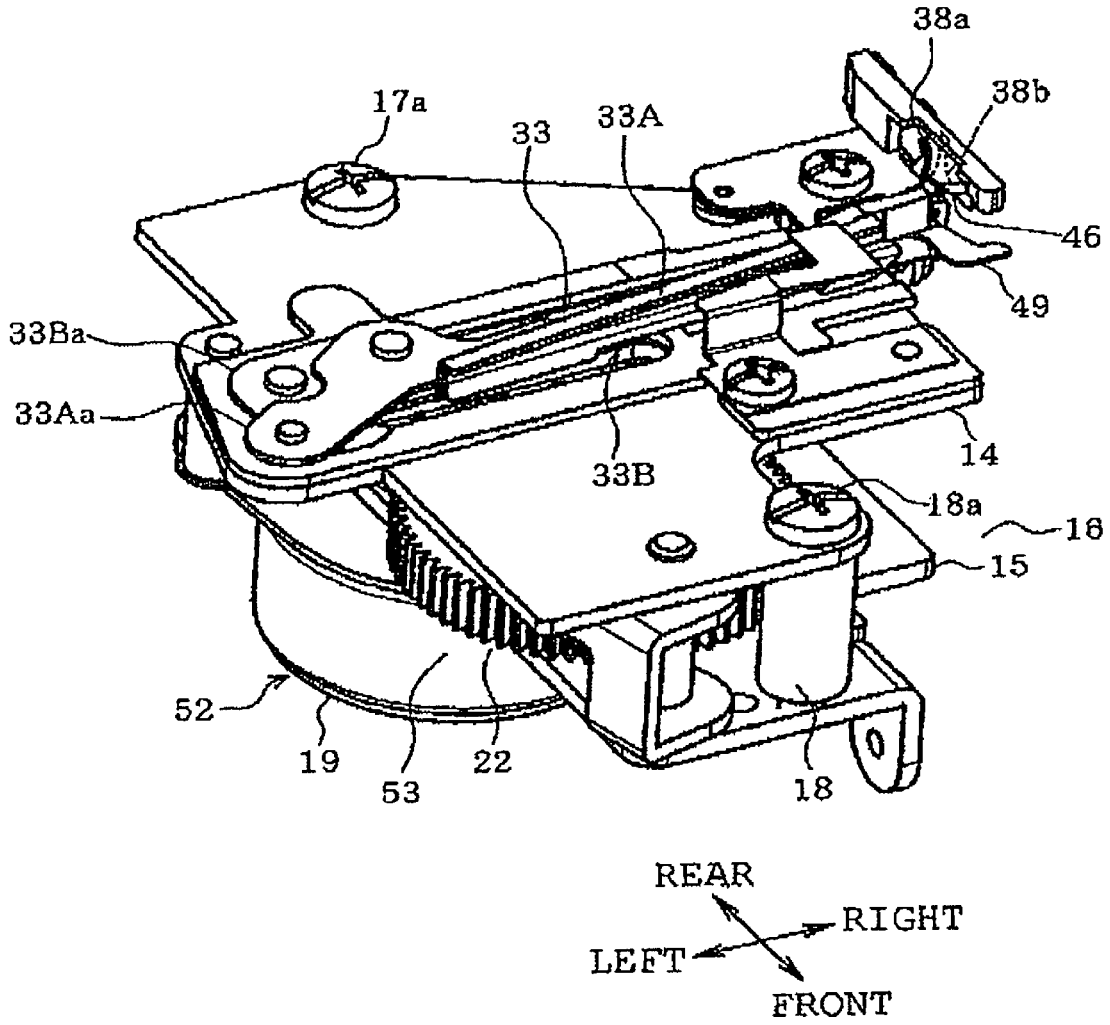
FIG. 5 is a perspective view of the thread cutter.

The above-described thread cutter 12 is located to the left of the horizontal rotary hook 11 as shown in FIG. 3A. In particular, the second thread seizing assembly 38 is located near to the left of the feed dog 10. In this case, in order that a cross-feed mechanism (not shown) may additionally be provided for moving the feed dog 10 in the right-and-left direction, the second thread seizing assembly 38 is located so as to be uninterrupted even when the feed dog 10 is moved by a predetermined distance in the right-and-left direction by the cross-feed mechanism.

Figure 9B:
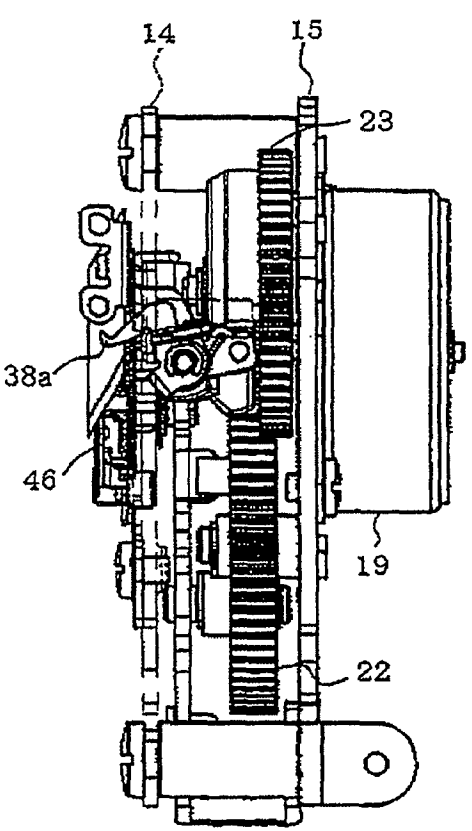
Figure 9A:
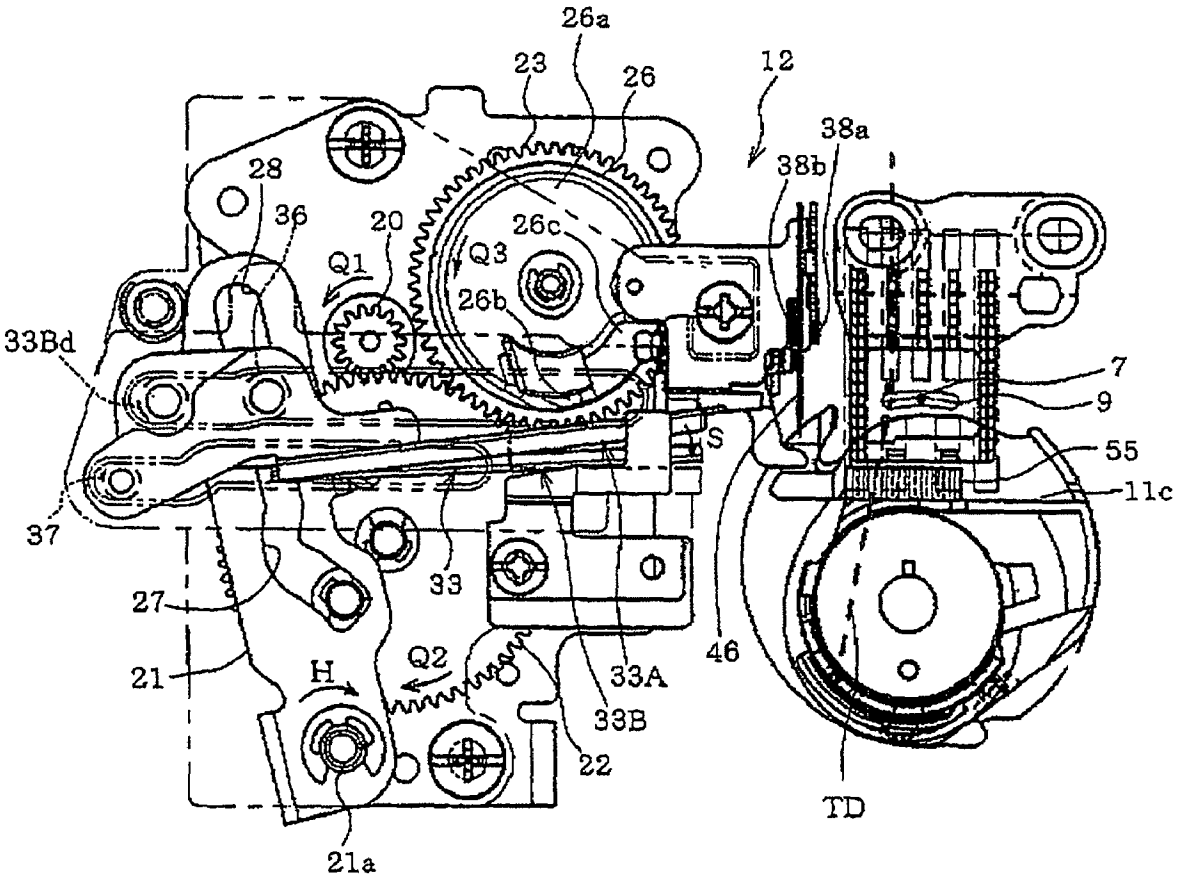

The upper surface of the bobbin case 11*b* includes a portion corresponding to a thread path as shown in FIG. 3A. A second piled member 55 is fixed by an adhesive agent to the aforesaid portion of the upper surface of the bobbin case 11*b*. The second piled member 55 is formed by densely transplanting short fibers with a predetermined length. The thread path starts from the bobbin 54 which is housed in the bobbin case 11*b* and from which the bobbin thread TD is drawn, ending at the needle hole 9*a* of the needle plate 9, as shown in FIG. 9A. The piled member 55 is provided for preventing the needle thread TU from twisting when a loop of needle thread TU is moved upward by a needle thread take-up after the loop has passed and has been detached from the bobbin case 11*b*. In FIG. 3A, the needle plate 9 and the cutting blade cover 47 are eliminated and the base upper plate 14 and the spacer 32 are shown by alternate long and two short dashes line.

Figure 21A:
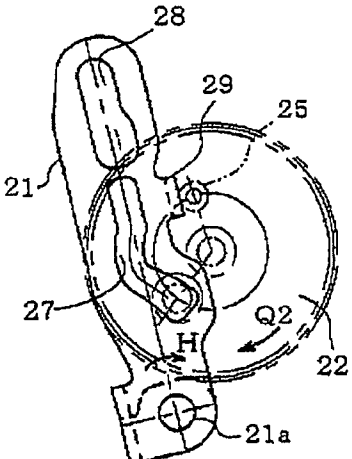
FIGS. 21A to 21F are views explaining movements of a swing pin, a drive lever push pin and a drive lever (Nos. 1 to 6)
Figure 21B:
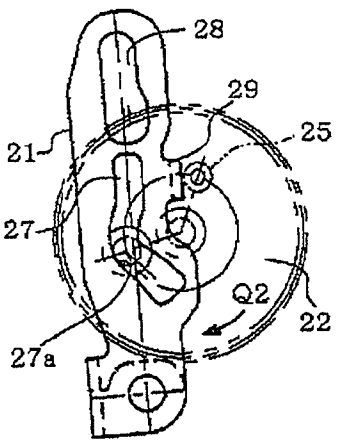
Figure 21C:
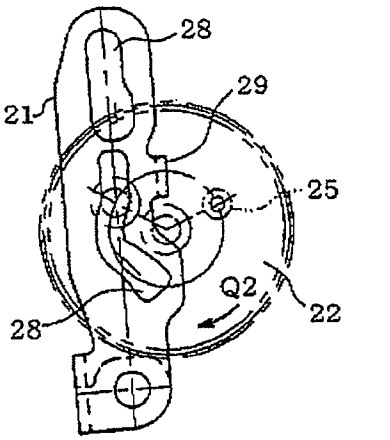
Figure 21D:
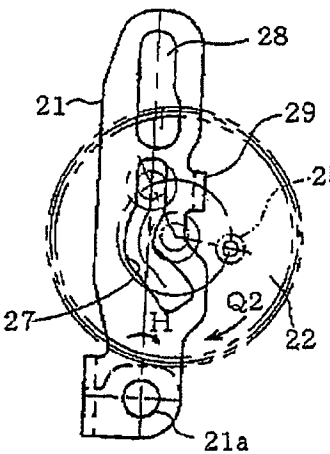
Figure 21E:
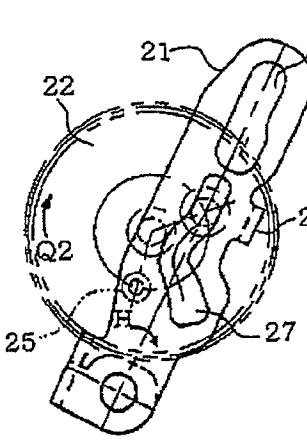
Figure 21F:
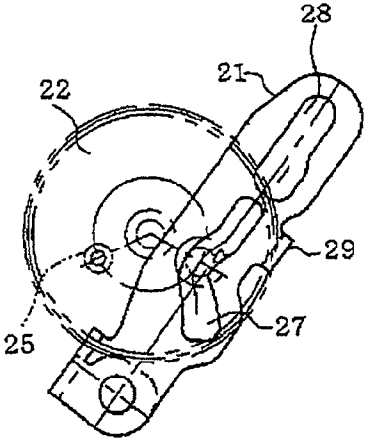

The operation of the thread cutter 12 will now be described with reference to FIGS. 9A and 9B to FIGS. 21A to 21F and the like. In FIGS. 9A and 9B to FIGS. 18A and 18B, the rotating hook 11*a*, needle plate 9 and cutting blade cover 47 are eliminated and the base upper plate 14 is shown by alternate long and two short dashes line. FIG. 21A to 21F show the relationship between the first driven gear 22 and the drive lever 21. The first driven gear 22 is shown by alternate long and two short dashes line. FIG. 21A shows an operating state corresponding to that shown in FIG. 9A. FIG. 21B shows an operating state in which the first driven gear 22 is further rotated in the direction of arrow Q2 from the state of FIG. 21A. FIG. 21C shows an operating state in which the first driven gear 22 is still further rotated in the direction of arrow Q2 from the state of FIG. 21B. FIG. 21D shows an operating state corresponding to that shown in FIG. 10A. FIG. 21E shows an operating state in which the first driven gear 22 is further rotated in the direction of arrow Q2 from the state of FIG. 21D. FIG. 21F shows an operating state corresponding to that shown in FIG. 11A.

Figure 11B:
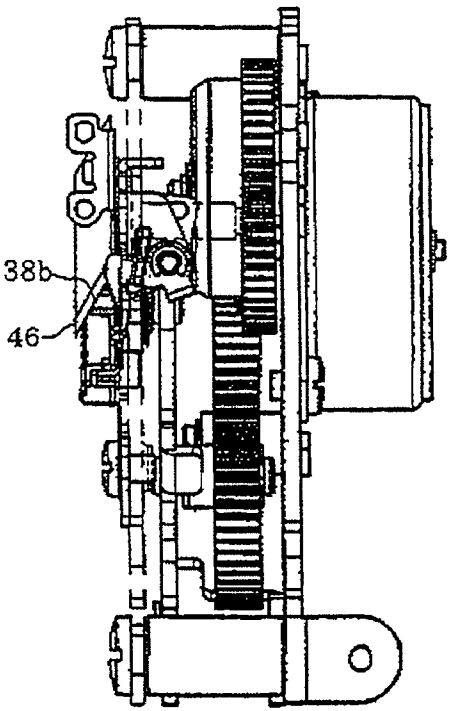
Figure 11A:
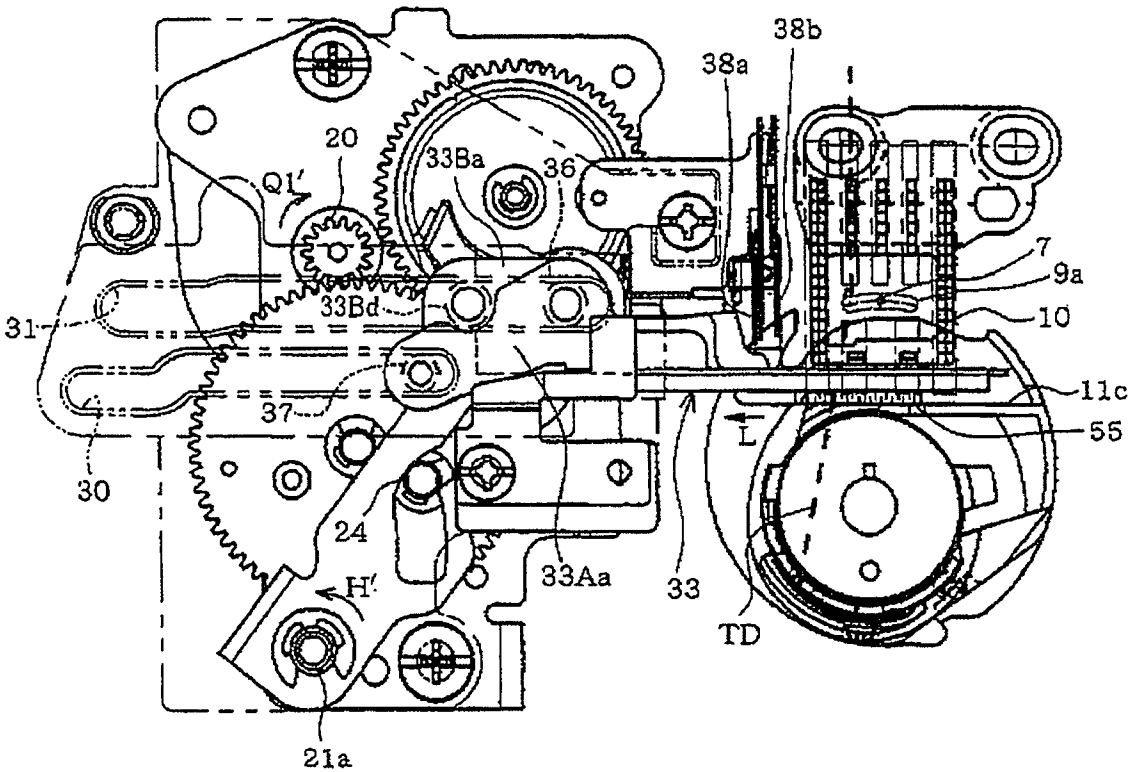

Firstly, the first thread seizing assembly 33 is on standby at a position in readiness as shown in FIG. 9A during a sewing operation of the sewing machine 1. Distal ends of the unit thread seizing members 33A and 33B are opened in the standby state of the first thread seizing assembly 33. The distal ends of both unit thread seizing members 33A and 33B are displaced backward such that the unit thread seizing members 33A and 33B are inclined. Subsequently, when the operator depresses the sewing start/stop switch 56 for completion of the sewing operation, the sewing machine 1 is stopped while the needle 7 is stuck in the workpiece cloth or located at the needle lower position. When the operator then depresses the thread cutting switch 59 to cut the needle and bobbin threads TU and TD, the stepping motor 19 is rotated in the direction of arrow Q1. The rotation of the motor 19 in the direction of arrow Q1 results in rotation of the first driven gear 22 in the direction of arrow Q2 and rotation of the second driven gear 23 in the direction of arrow Q3. The rotation of the first driven gear Q2 rotates the driving pin 24 in the same direction of arrow Q2, so that the drive lever 21 is swung in the direction of arrow H. The thread cutter 12 assumes the position prior to the striding of the first thread seizing assembly 33 over the bobbin thread as shown in FIG. 11A.

Figure 10B:
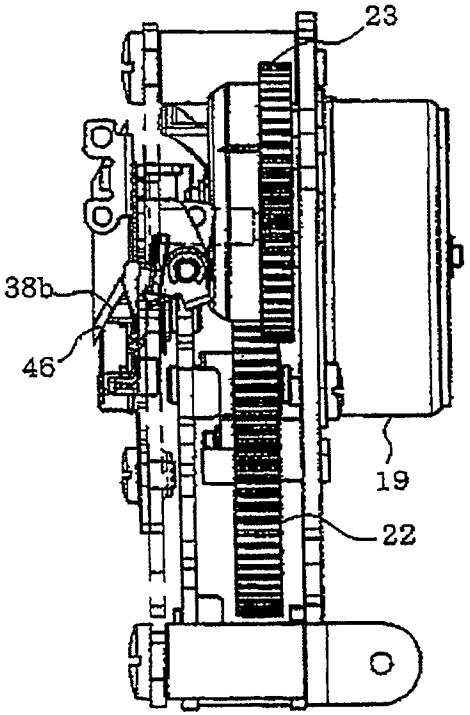
Figure 10A:
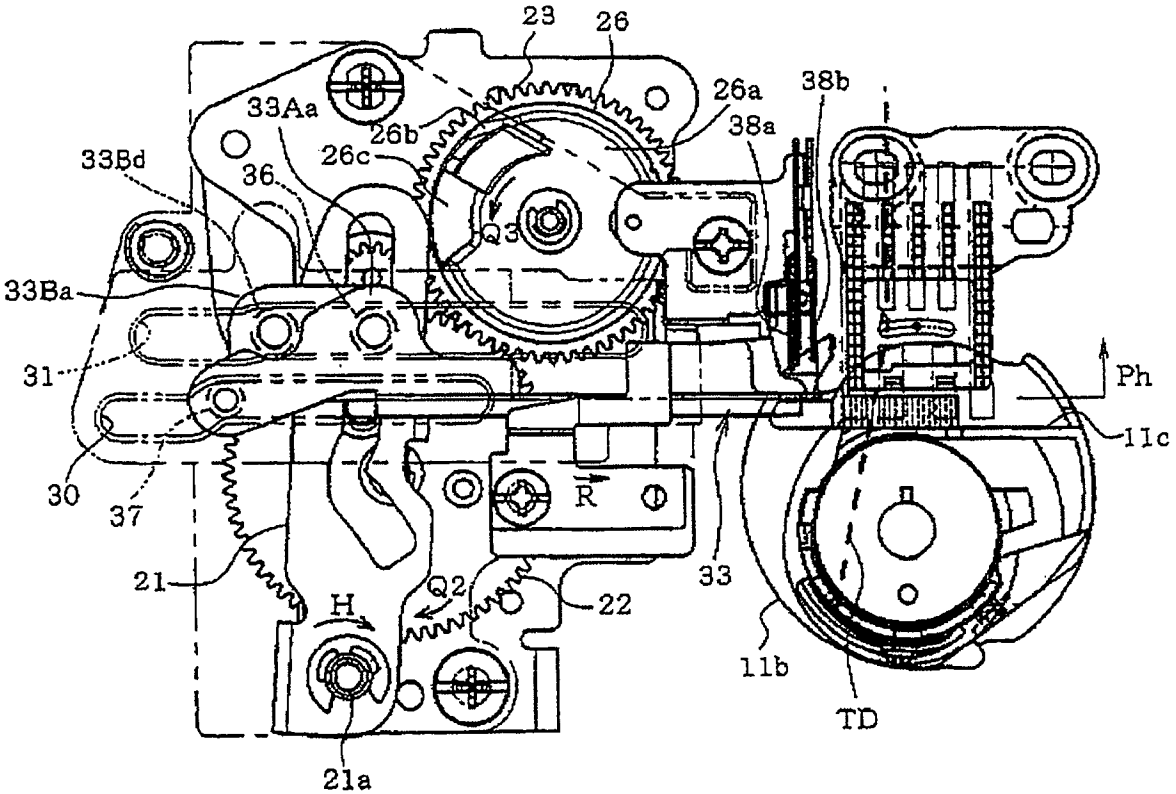

The swing shaft 36 of the unit thread seizing member 33A is moved into the main groove 31*c* of the second elongated groove 31 before the state as shown in FIG. 10A is reached. The auxiliary shaft 37 is moved into the main groove 30*c* of the first elongated groove 30. Accordingly, the unit thread seizing member 33A is moved in the direction arrow S (see FIG. 9A), thereby assuming a substantially non-inclined state. Furthermore, the swing shaft 36 is moved into the main groove 31*c* of the second elongated groove 31 while being fitted in the shaft hole 33Bc of the unit thread seizing member 33B. Additionally, the secondary shaft 33Bd is also moved into the main groove 31*c* of the second elongated groove 31. Accordingly, the other unit thread seizing member 33B also assumes a substantially non-inclined state. As a result, both unit thread seizing members 33A and 33B are directed in the forward direction of the reciprocation (the direction of arrow R) with an overlap.

The cam contact pin 40 in the condition as shown in FIG. 8A passes the inclined portion 26*b* from the lower surface 26*c* as the result of rotation of the cam 26 in the direction of arrow Q3 in FIG. 9A when the first thread seizing assembly 33 is changed from the state of FIG. 9A to the state of FIG. 1A. The cam contact pin 40 is then moved to the upper surface 26*a* and is accordingly displaced upward relative to the state as shown in FIG. 8A. Accordingly, the distal end of the second thread seizing assembly 38 is swung so as to be leaned forward from the rising state as shown in FIG. 9B (see FIG. 10B).

The first driven gear 22 and accordingly, the drive pin 24 are rotated in the direction of arrow Q2 when state as shown in FIG. 9A progresses to the state as shown in FIG. 10A. In this case, the left edge 27*a* of the curbed portion of the first guide groove 27 is generally arc-shaped. Accordingly, in the case where the drive pin 24 slides along the left edge 27*a*, the drive lever 21 is not swung in the direction of arrow H even when the first driven gear 22 is rotated. In other words, there is a time period in which the swing of the drive lever 21 is stopped.

The rotative movement of the driving pin 24 of the first driven gear 22 swings the drive lever 21 in the direction of arrow H in FIG. 9A when the driving gear 20 is further rotated in the direction of arrow Q1 (see FIG. 9A) in the state prior to the striding of the first thread seizing assembly 33 over the bobbin thread TD as shown in FIGS. 10A and 10B. As a result, the first thread seizing assembly 33 is moved in the direction of arrow R such that the distal end of the first thread seizing assembly 33 passes over the bobbin thread TD while being brought into sliding contact with the upper side of the second piled member 55. Consequently, the seizing member 33 reaches a maximum protrusion position (see FIGS. 11A and 11B). The cam contact pin 40 is located on the upper surface 26*a* of the cam 26 when the seizing member 33 occupies the maximum protrusion position. Accordingly, the distal end of the second thread seizing assembly 38 remains leaned forward. In this case, the unit thread seizing members 33A and 33*b* of the first thread seizing assembly 33 are overlapped such that the width is reduced in planar view. Accordingly, the first thread seizing assembly 33 is allowed to proceed into a narrow space between the feed dog 10 and the wall 11*c* of the bobbin case 11*b*.

Figure 12B:
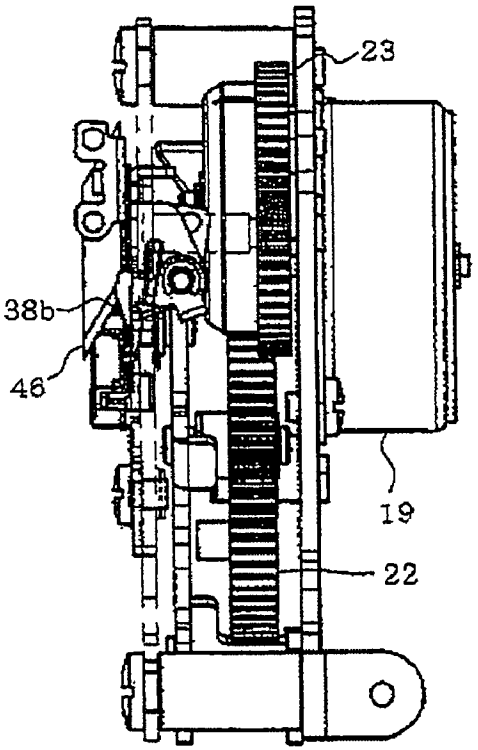
Figure 12A:
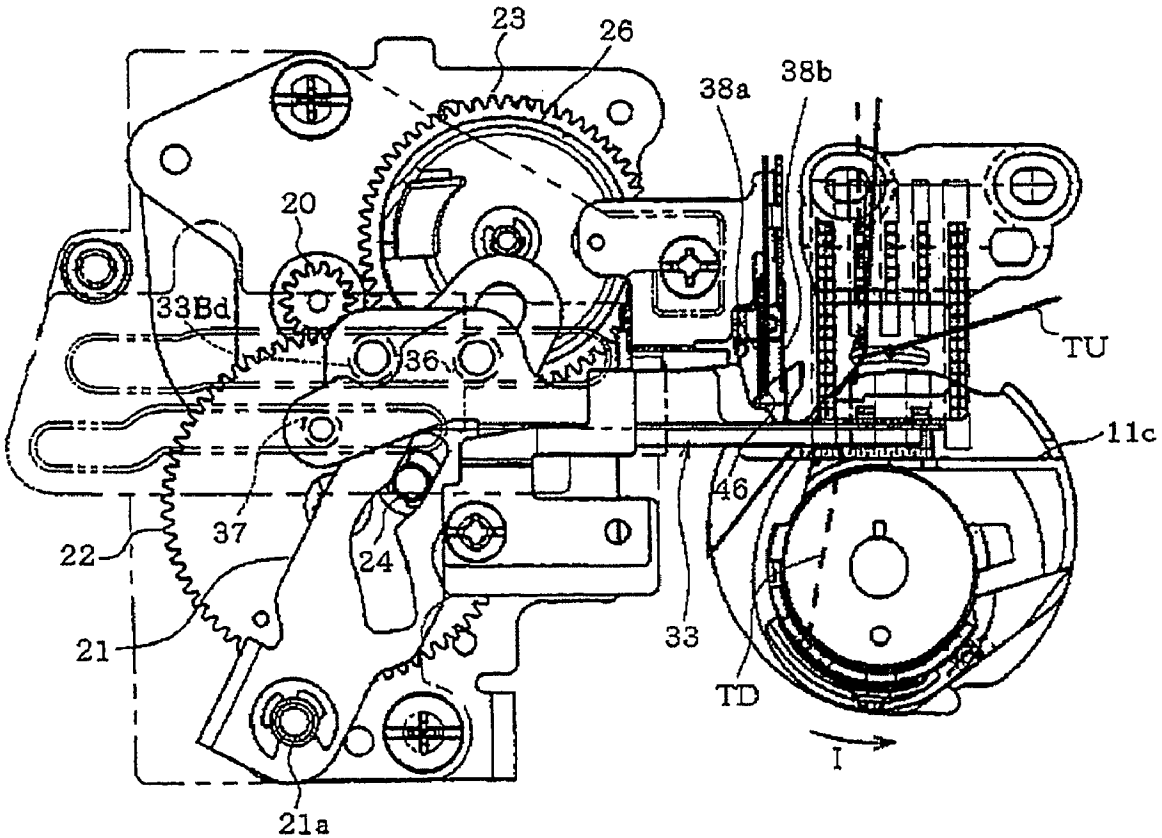
Figure 13B:
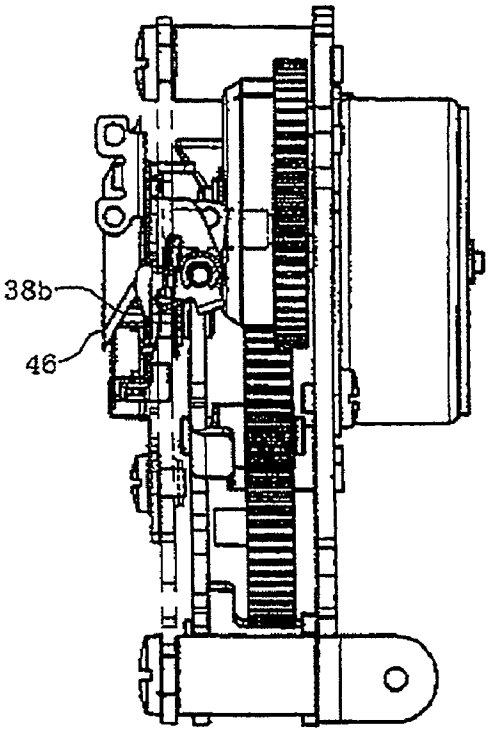
Figure 13A:
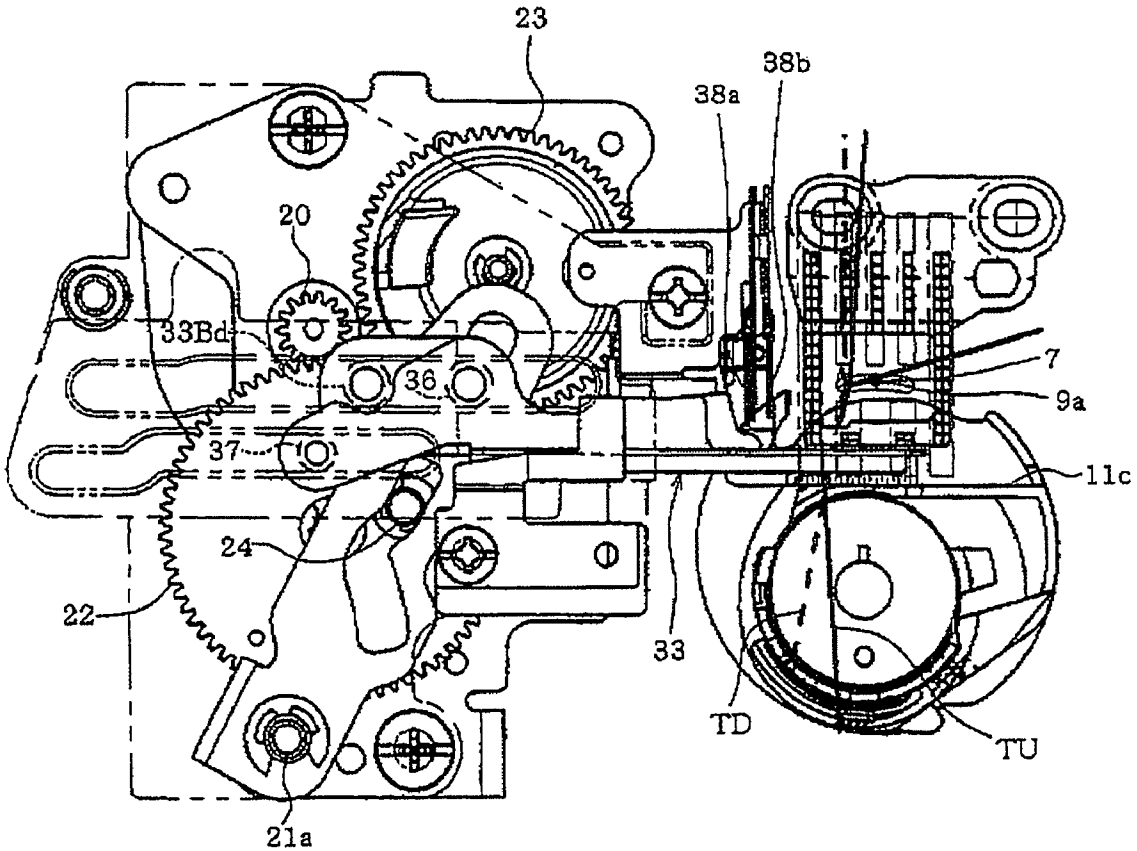

The stepping motor 19 is then rotated in the reverse direction (in the direction of arrow Q1') from the state shown in FIG. 11A to be stopped. As a result, the drive lever 21 is swung in the direction opposite the above-mentioned direction (in the direction of arrow H' in FIG. 11A), so that the first thread seizing assembly 33 is moved slightly in the rearward direction of reciprocation (direction of arrow L in FIG. 11) and then stopped. In this state, the thread cutter 12 is on standby for the threading of the needle thread as shown in FIGS. 12A and 12B. The lower shaft 13 is driven in this state so that the rotating hook 11*a* (see FIG. 3) is rotated. A loop of needle thread TU located in the rear of the eye of the needle 7 is seized by a seizing beak (not shown) provided on the rotating hook 11*a*. The rotating hook 11*a* is continuously rotated so that the needle thread TU is moved in the direction of arrow I in FIG. 12A (also see FIG. 13A). FIG. 20A shows the conditions of the first thread seizing assembly 33 and the needle and bobbin threads TU and TD in the above-described case. When the rotating hook 11*a* is further rotated continuously, the needle thread TU passes the bobbin case 11*b* and is detached from the first thread seizing assembly 33, thereafter being pulled upward by the needle thread take-up (not shown) as shown in FIG. 14A. As a result, the needle thread TU is folded back at the middle of the first thread seizing assembly 33 as shown in FIGS. 14A and 20B.

Figure 14B:
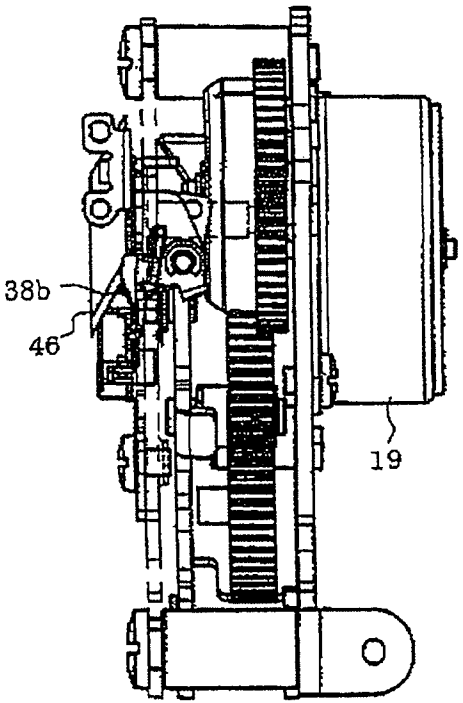
Figure 14A:
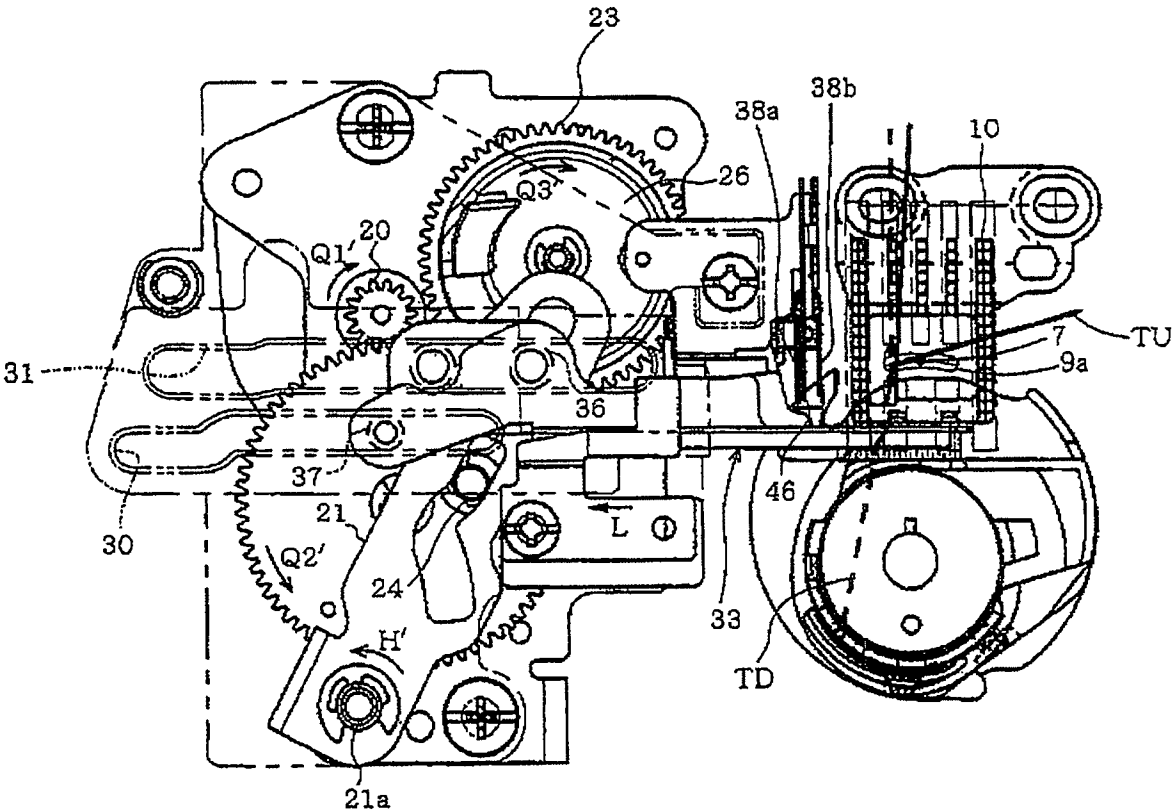
Figure 15B:
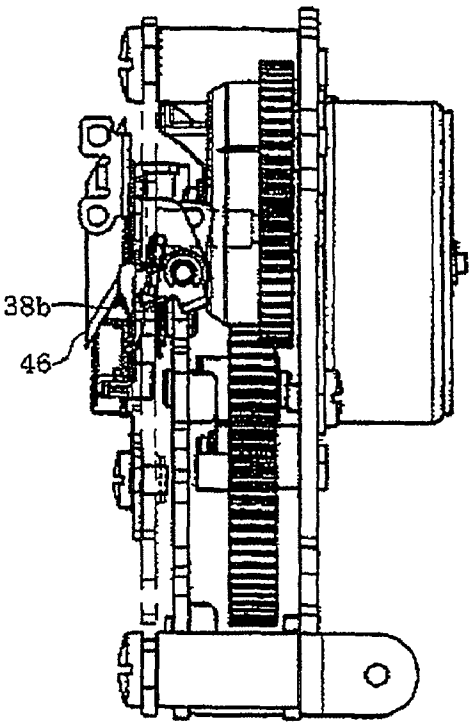
Figure 15A:
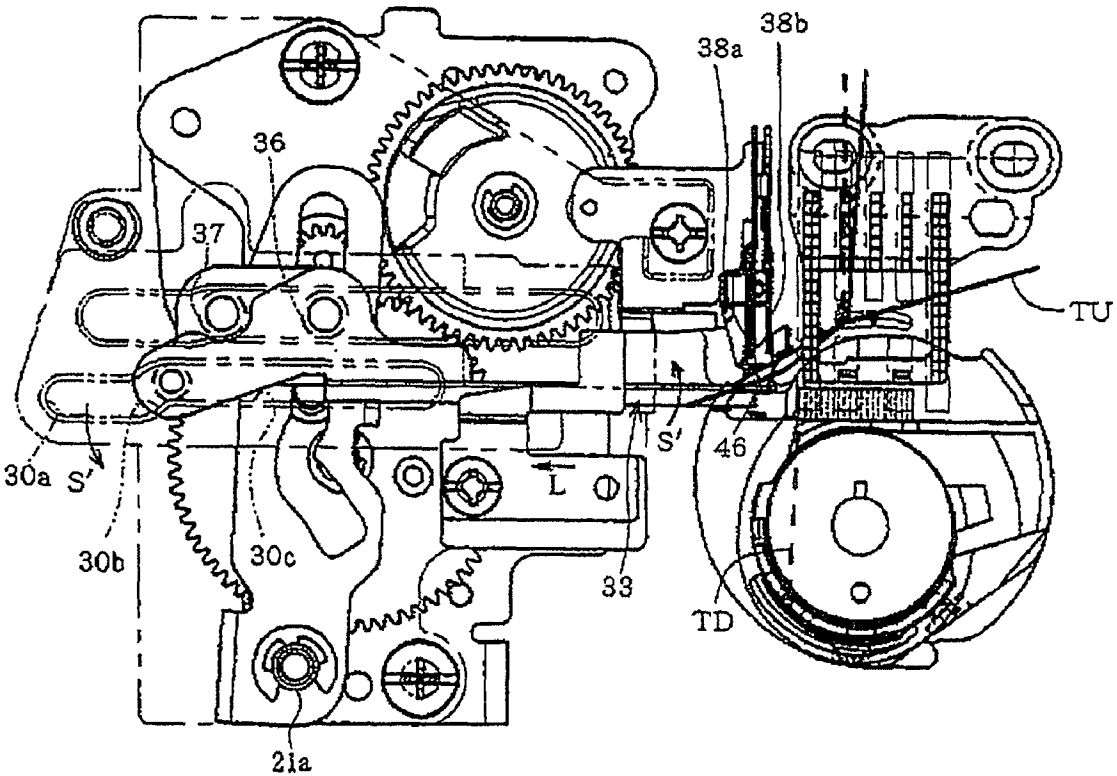

In the state as shown in FIG. 14A, the stepping motor 19 is rotated in the direction of Q1' to swing the drive lever 21 in the direction of arrow H' in FIG. 14. Consequently, the first thread seizing assembly 33 is moved in the backward direction or direction of arrow L (the backward movement of reciprocation), so that the needle and bobbin threads TU and TD are seized by the first thread seizing portions 35A and 35B of the first seizing member 33. In this case, the auxiliary shaft 37 of the first thread seizing assembly 33 slides along the oblique portion 30*b* of the first elongated groove 30 leftward frontward. Accordingly, the unit thread seizing member 33A is moved in the rearward direction of reciprocation while being swung in the direction of arrow S' in FIG. 15A about the swing shaft 36. The first thread seizing portion 35A provided on the distal end of the unit thread seizing member 33A is swung in such a direction that the first thread seizing portion 35A comes close to the second thread seizing assembly 38 (see FIG. 16A). Substantially simultaneously, the auxiliary shaft 37 of the other unit thread seizing member 33B is slid ahead on the left along the oblique portion 31*b* of the second elongated groove 31. Accordingly, the unit thread seizing member 33B is moved in the backward in the reciprocation while being swung slightly in the direction of arrow S' in FIG. 15A about the swing shaft 36. As a result, the first thread seizing portion 35B provided on the lower distal end of the unit thread seizing member 33B is swung so as to come close to the second thread seizing assembly 38 (see FIG. 16A).

Figures 19A, 19B, 19C:
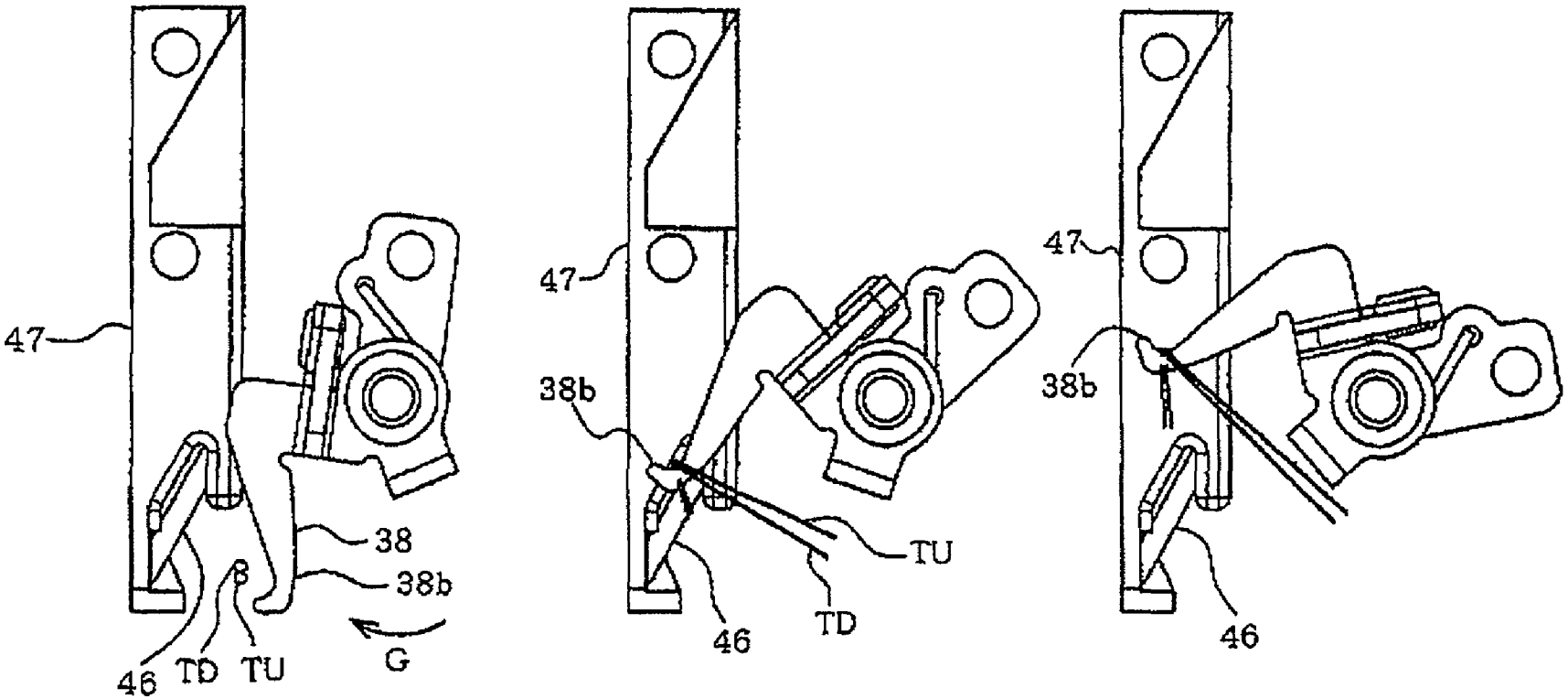
FIGS. 19A, 19B and 19C show manners of cutting threads by the second thread seizing assembly in sequential operation stages.

In this case, the needle and bobbin threads TU and TD at the workpiece cloth side (the rear side in FIG. 16A) is shown in FIG. 19A. Furthermore, the rear surface of the distal end of the first thread seizing assembly 33 is brought into contact with the first piled member 48. As a result, the needle and bobbin threads TU and TD are lightly held between the rear surface of the distal end of the first thread seizing assembly 33 and the first pilled member 48.

Figure 16B:
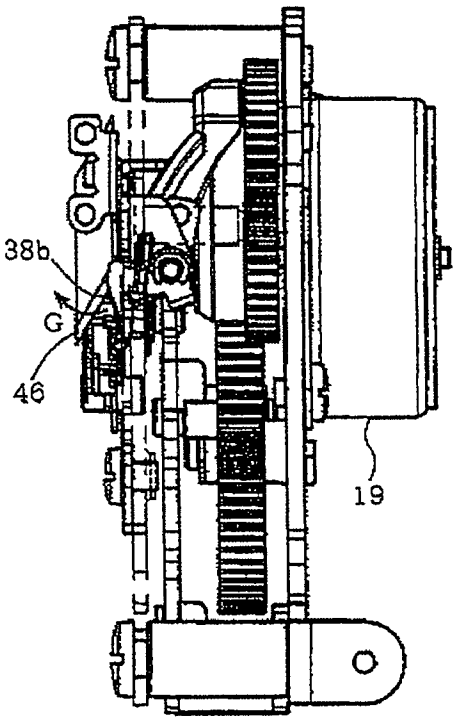
Figure 16A:
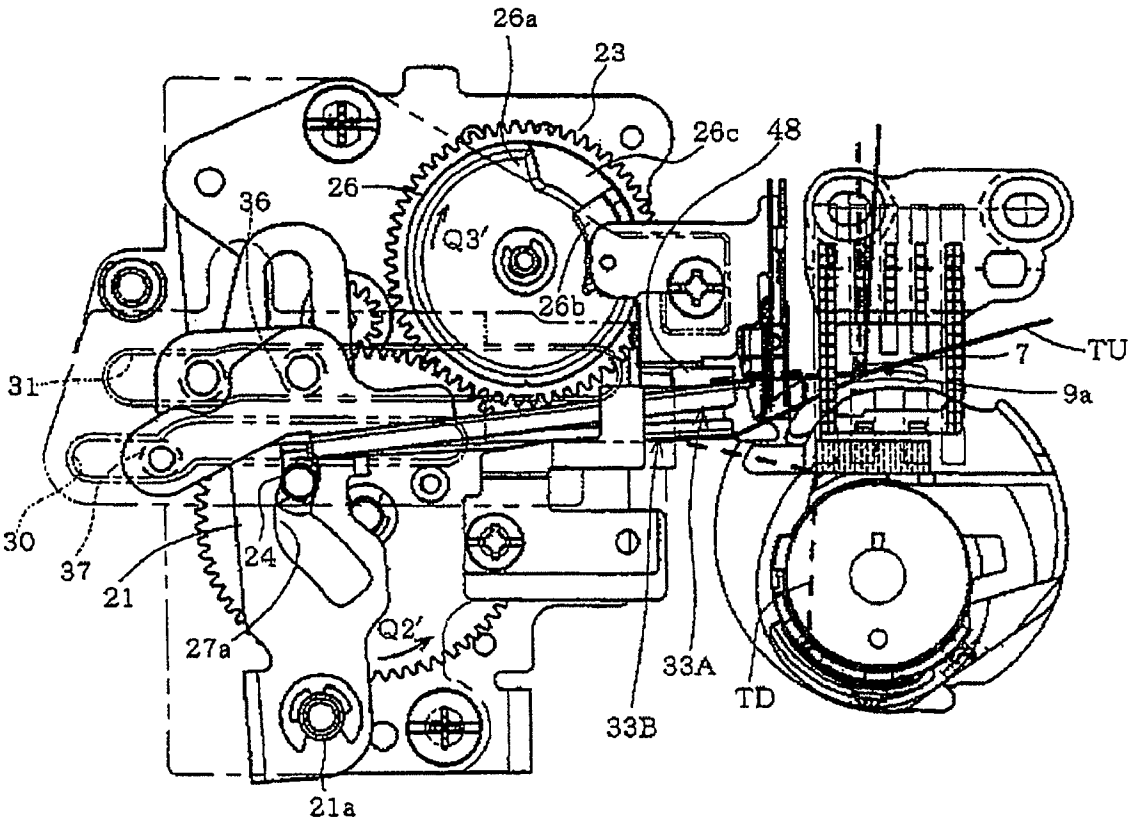

In the state as shown in FIG. 16A, the cam contact pin 40 is moved from the upper surface 26*a* of the cam 26 in rotation in the direction Q3', being located at a position just before the cam contact pin 40 is brought into contact with the inclined portion 20*b*. Furthermore, in the state shown in FIG. 16A, the drive pin 24 in rotation in the direction of arrow Q2' is brought into sliding contact with the left edge 27*a* of the arc-shaped curved portion of the first guide groove 27. Accordingly, the drive lever 21 is stopped without being swung although the stepping motor 19 is kept rotating, as described above. Consequently, the first thread seizing assembly 33 is stopped in an inclined state as the result of swing and is retained in the stopped state.

The second thread seizing assembly 38 is driven in the stopped state of the first thread seizing assembly 33 (stopped state as shown in FIG. 16A). More specifically, the cam contact pin 40 is brought into contact with the inclined portion 26*b* of the cam 26 under rotation in the direction of arrow Q3' as shown in FIG. 8B and is thereafter moved to the lower surface 26*c* as shown in FIG. 8A. Accordingly, the second thread seizing assembly 38 is swung in the direction of arrow G in FIG. 16B. More specifically, portions of the seized needle and bobbin threads TU and TD located at the workpiece cloth side are seized by the unit thread seizing member 33A of the first thread seizing assembly 33 in the direction of arrow G, as shown in FIGS. 19A to 19C. The needle and bobbin threads TU and TD are cut by the cutting blade 46 when the second two-forked thread seizing assembly 38 passes both sides of the cutting blade 46, as shown in FIGS. 17B, 18B, 19B and 19C.

Figure 17B:
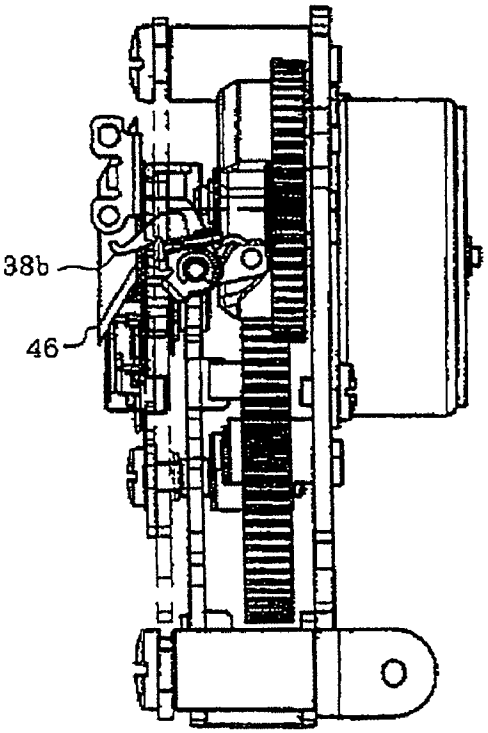
Figure 17A:
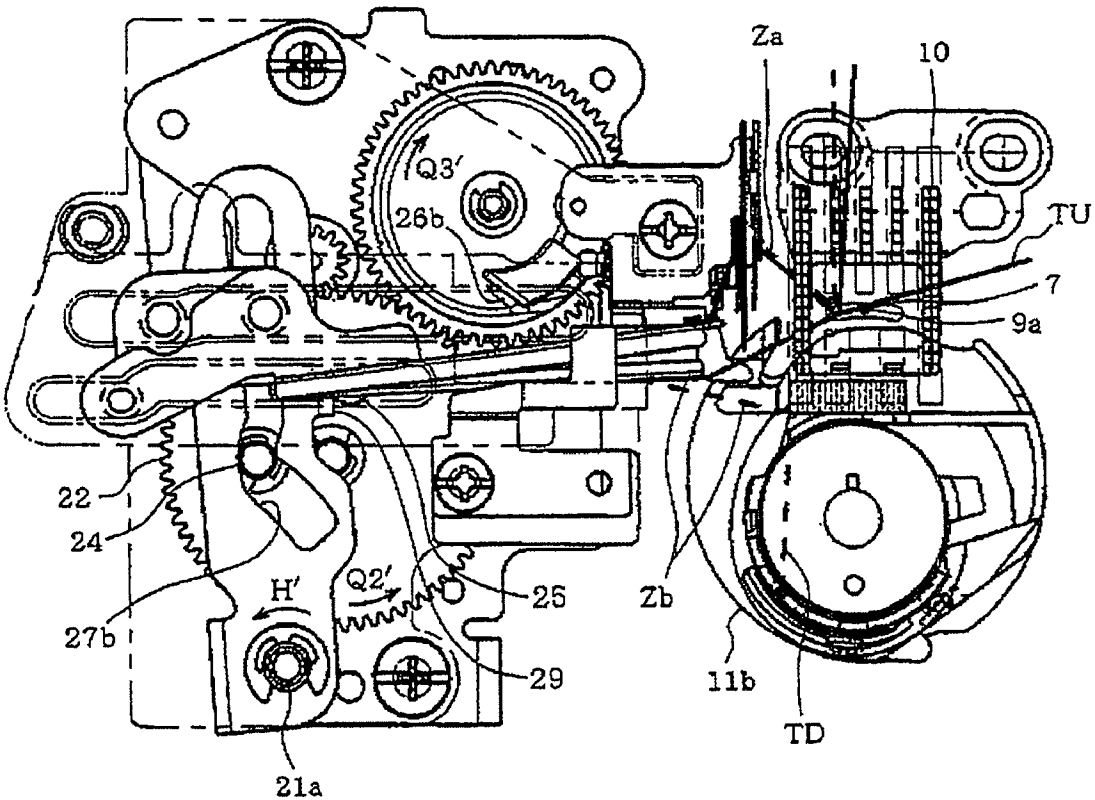
Figure 18B:
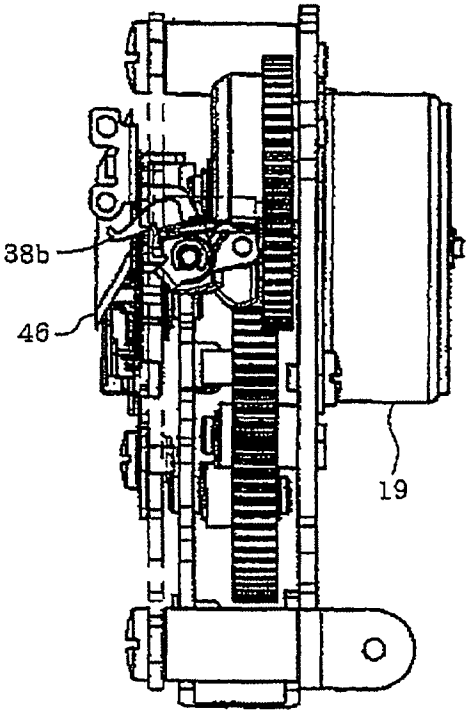
Figure 18A:
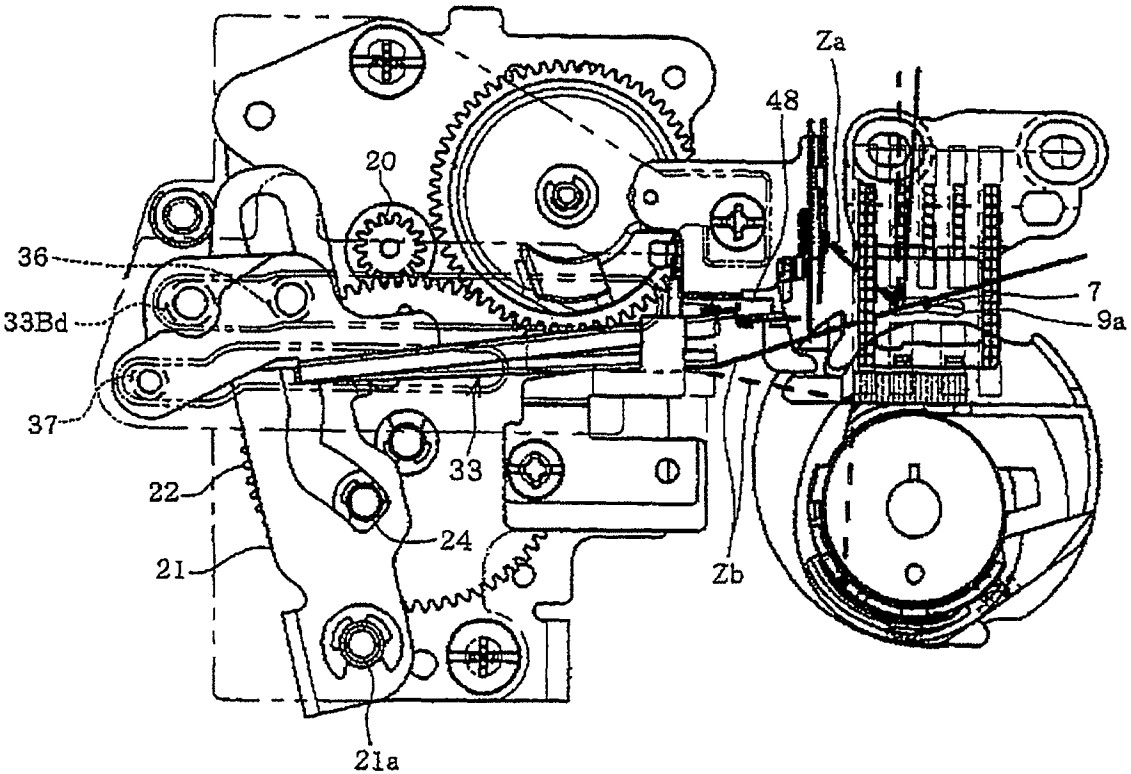

The needle and bobbin threads TU and TD are cut by the cutting blade 46 so that a remaining amount Za of the needle and bobbin threads TU and TD at the workpiece cloth side is small as understood from FIG. 17A. Furthermore, the needle and bobbin threads TU and TD are cut by the cutting blade 46 so that a remaining amount Zb of the needle thread TU at the needle 7 side and the bobbin thread TD at the bobbin 54 side ensures an amount of thread necessary to form an initial stitch in a subsequent sewing operation. In the state as shown in FIG. 17A, the drive pin 24 under rotation in the direction of arrow Q2' is in sliding contact with the arc-shaped left edge 27*a* of the curved portion of the first guide groove 27. The drive pin 24 does not operate to push the drive lever 21 in the direction of arrow H' even when rotated in the direction of arrow Q2' from the location as shown in FIG. 17A. In this case, the drive-lever push pin 25 of the first driven gear 22 pushes the push strip 29 of the drive lever 21 in the direction of arrow H'. The drive-lever push pin 25 keeps pushing the push strip 29 until the state as shown in FIG. 18A or the initial standby position is reached. This is a change from the state as shown in FIG. 22B to the state as shown in FIG. 22A. The thread cutting is thus completed.

The ends of needle and bobbin threads TU and TD are lightly held between the rear surface of the distal end of the unit thread seizing member 33A and the first piled member 48 in the state as shown in FIG. 18A. The needle thread TU is drawn to the upper side of the needle plate 9 by the operator before the subsequent sewing operation starts. However, the end of the bobbin thread TD still remains held between the rear surface of the unit thread seizing member 33A and the first piled member 48. When the subsequent sewing operation starts in the aforesaid state, the bobbin thread TD is drawn in an initial stitch forming when the needle thread TU passes the bobbin case 11*b*. As a result, the end of the bobbin thread TD is pulled between the rear surface of the unit thread seizing member 33A and the first piled member 48. More specifically, the end of the bobbin thread TD is reliably held until an initial stitch is formed in a subsequent sewing operation. This can prevent occurrence of failure or trouble such as thread entanglement in an initial stitch in the subsequent sewing operation or inability to form stitches.

According to the foregoing embodiment, the cutting blade 46 is disposed at the location deflected to the needle hole 9*a* side relative to the movement locus of the first thread seizing assembly 33 (the location deflected in the direction of arrow Ph in FIG. 10A). The needle and bobbin threads TU and TD seized by the first thread seizing assembly are further seized by the second thread seizing assembly 38 during the backward movement of the first thread seizing assembly 33. The second thread seizing assembly 38 cuts the needle and bobbin threads TU and TD in cooperation with the cutting blade 46 at the location deflected to the needle hole 9*a* relative to the movement locus of the first thread seizing assembly 33. Consequently, a remaining amount of the needle and bobbin threads TU and TD can be rendered smaller as compared with the conventional construction in which the thread is cut by the cutting blade at the movement locus of the thread seizing assembly.

Furthermore, when the needle and bobbin threads TU and TD seized by the first thread seizing assembly 33 are further seized by the second thread seizing assembly 38, the distal ends of the two unit thread seizing members 33A and 33*b* of the first thread seizing assembly 33 are moved in the direction intersecting the movement direction of the first thread seizing assembly 33 (the direction of arrow R or L), so as to be spaced from each other by a predetermined distance. As a result, a distance is increased between a thread-seizing part of the first thread seizing portion 35A of the unit thread seizing member 33A and a thread-seizing part of the first thread seizing portion 35B of the other unit thread seizing member 33B of the first thread seizing assembly 33, as shown in FIG. 12D. Consequently, the threads can be seized by the second thread seizing assembly easily and reliably.

Figure 22:
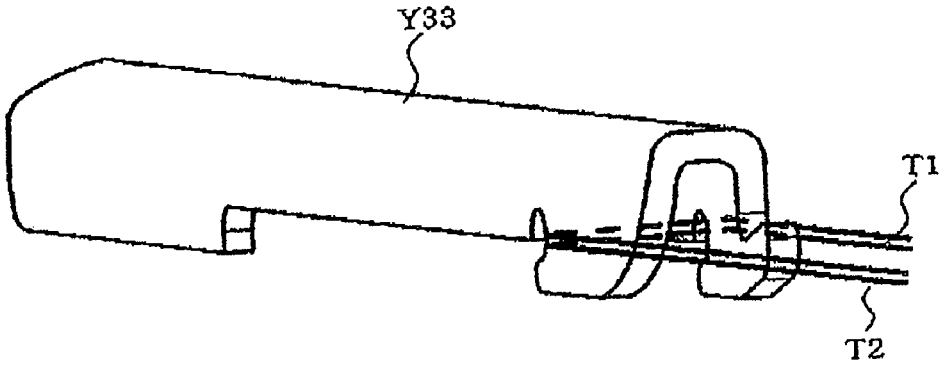
FIG. 22 is a view similar to FIG. 20C, showing a reference example.
Figure 23:
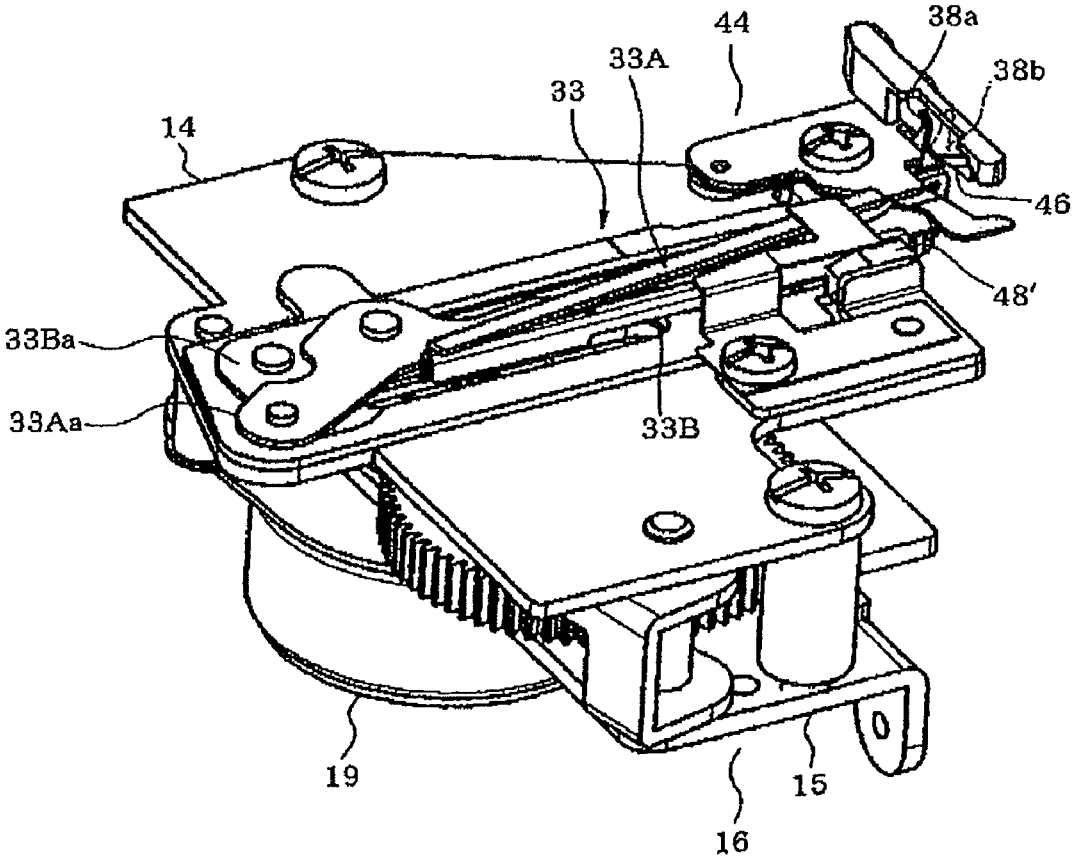
FIG. 23 is a view similar to FIG. 5, showing the thread cutter of a second example.
Figure 24A:
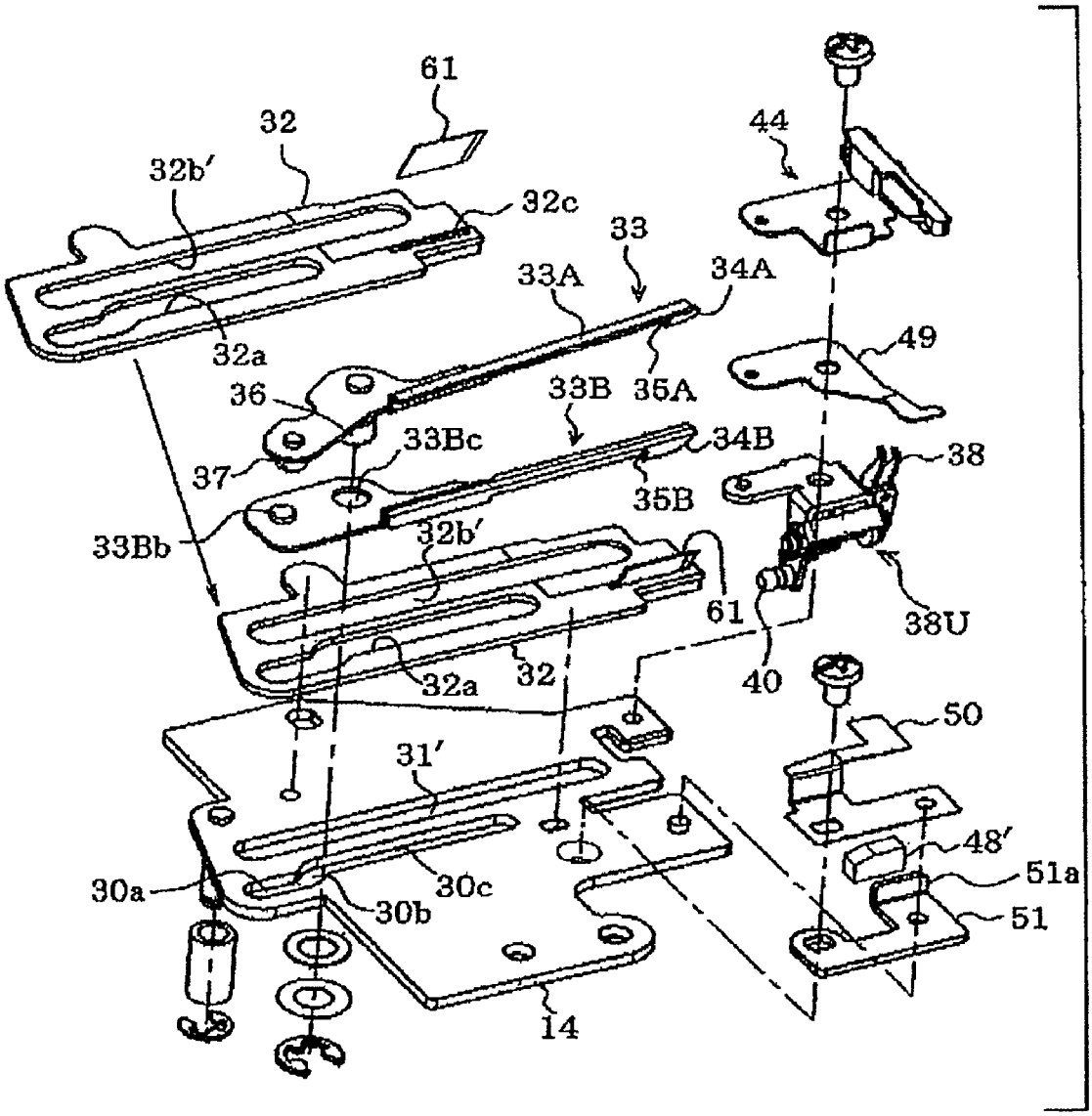
FIGS. 24A to 24D are views similar to FIGS. 7A to 7D respectively.
Figure 24B:
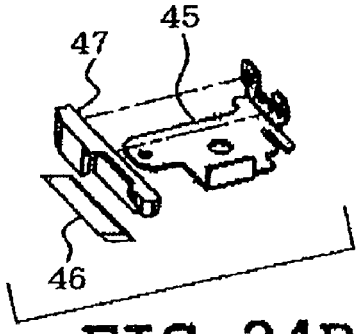
Figure 24C:
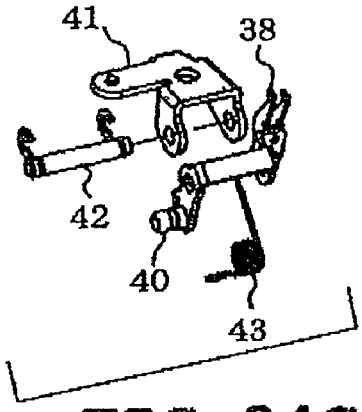
Figure 24D:
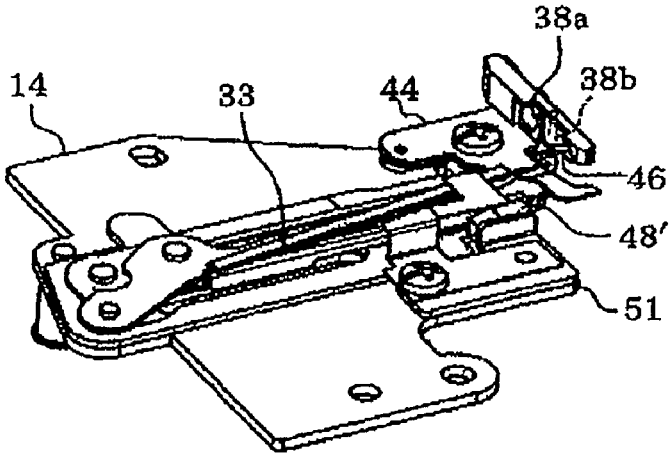

A reference view of FIG. 22 shows a first thread seizing assembly comprising a unit member Y33, for example. When the needle and bobbin threads TU and TD are seized by the shown unit member Y33, portions T1 of the needle and bobbin threads TU and TD located at the workpiece cloth side are close to portions T2 of the threads TU and TD located at the needle side. As a result, a considerable degree of accuracy is necessitated in order that only the portions T1 of the needle and bobbin threads TU and TD at the workpiece cloth side may be seized by the second thread seizing assembly 38.

In the embodiment, however, a distance is increased between the thread-seizing part of the first thread seizing portion 35A of the unit thread seizing member 33A and the thread-seizing part of the first thread seizing portion 35B of the other unit thread seizing member 33B of the first thread seizing assembly 33, as described above with reference to FIG. 12D. Consequently, only the parts of the needle and bobbin threads TU and TD located at the workpiece cloth side can be seized by the second thread seizing assembly 38 easily and reliably.

Furthermore, the distal ends of the two unit thread seizing members 33A and 33B are moved before the needle and bobbin threads TU and TD are seized by the second thread seizing assembly 38. Accordingly, when the needle and bobbin threads TU and TD are to be seized by the second thread seizing assembly 38, the distance can reliably be increased between the thread-seizing part of the first thread seizing portion 35A of the unit thread seizing member 33A and the thread-seizing part of the first thread seizing portion 35B of the other unit thread seizing member 33B of the first thread seizing assembly 33. Consequently, the portions of the needle and bobbin threads TU and TD located at the workpiece cloth side can reliably be seized by the second thread seizing assembly 38.

Furthermore, the two unit thread seizing members 33A and 33B of the first thread seizing assembly 33 are movable so as to be swung. Consequently, the distance between the thread-seizing parts of the first and second thread seizing portions 35A and 35B can be increased by a simple construction. At least one of the unit thread seizing members 33A and 33B may be constructed to be movable so as to be swung although both unit thread seizing members 33A and 33B are movable so as to be swung in the embodiment.

Furthermore, when moved backward in the reciprocation, the first thread seizing assembly 33 is swung so that the first thread seizing portion 35 comes close to the second thread seizing assembly 38. Consequently, the needle and bobbin threads TU and TD seized by the first thread seizing assembly 33 can be guided to the location where the threads are close to the second thread seizing assembly 38, whereupon the thread seizure by the second thread seizing assembly 38 can be rendered reliable.

Furthermore, when moved backward in the reciprocation, the first thread seizing portion 35A of the unit thread seizing member 33A which is one of the two unit thread seizing members 33A and 33B is swung so as to come close to the second thread seizing assembly 38. Accordingly, the distance between the thread-seizing parts of the first and second thread seizing portions 35A and 35B can be increased only by swinging one 33A of the two unit thread seizing members 33A and 33B during the backward movement of the reciprocation in which time the thread seizure needs to be carried out by the first thread seizing assembly. Thus, the distance between the thread-seizing parts of the first and second thread seizing portions 35A and 35B can reliably be increased by a simple construction.

Furthermore, the first guide portion 27 is formed with the arc-shaped curved portion 27*a* so that the drive lever 21 is stopped even when the drive pin 24 is rotated in the direction of arrow Q2'. As a result, the first thread seizing assembly is held in the stopped state when the second thread seizing assembly 38 is driven. Accordingly, the thread seizure can be carried out by the second thread seizing assembly 38 while the drawing of the needle and bobbin threads TU and TD is stopped. Consequently, the needle and bobbin threads TU and TD can be seized by the second thread seizing assembly 38 further reliably. Further, a remaining amount of thread can be rendered smaller since an extra amount of threads is not drawn out.

Furthermore, the distal end of the second thread seizing assembly 38 is forked into the second thread seizing portions 38*a* and 38*b* which are located so as to interpose the cutting blade 46 therebetween. Consequently, the needle and bobbin threads TU and TD can reliably be cut in cooperation of the second thread seizing assembly 38 with the cutting blade 46.

Furthermore, the second thread seizing assembly 38 is supported on the support shaft 42 secured to the base upper plate 14, so as to be swingable. Consequently, the needle and bobbin threads TU and Td can be seized by a simple construction. Furthermore, the drive unit 52 for driving the first thread seizing assembly 38 comprises the single stepping motor 19 and the drive mechanism 53 driven by the stepping motor 19. Consequently, since the first and second thread seizing assemblies 33 and 38 are driven by the stepping motor 19 and the drive mechanism 53, the construction of the thread cutter 12 can be simplified.

Furthermore, the drive mechanism 53 comprises the drive lever 21 driving the first thread seizing assembly 33, the drive pin 24 rotated so that the drive lever 21 is swung, and the cam 26 swinging the second thread seizing assembly 38. The drive pin 24 and the cam 26 are driven by the stepping motor 19. Consequently, the construction of the thread cutter 12 can be further simplified since both the first and the second thread seizing assemblies 33 and 38 are driven by the single stepping motor 19.

A second embodiment will now be described with reference to FIGS. 23 to 29C. The thread cutter of the second embodiment is provided with a secondary cutting blade 61. The secondary cutting blade 61 is provided for cutting the needle and bobbin threads TU and TD seized by the first thread seizing assembly 33, at a predetermined location in the backward movement of the reciprocation of the first thread seizing assembly 33. Furthermore, the second embodiment differs from the first embodiment in that the second elongated groove 31' of the base lower plate 15 (see FIG. 24A) is formed into a straight shape and directed in the forward and backward directions of the reciprocation.

The secondary cutting blade 61 is inserted in a groove 32*c* which is formed in the spacer 32 into a straight shape so as to be directed in the forward and backward directions of the reciprocation. A second elongated groove 31' is formed into a straight shape and directed in the forward and backward directions of the reciprocation, and an elongated groove 32*b*' of the spacer 32 is also formed into a straight shape accordingly.

According to the foregoing construction, the unit thread seizing member 33B of the first thread seizing assembly 33 is moved straightforward in the forward and backward directions of the reciprocation without being swung. The secondary cutting blade 61 is located on a movement locus of the unit thread seizing member 33B. The other unit thread seizing member 33A is moved and swung in the same manner as in the first embodiment.

A second piled member 48' made from the same material as the first pile member 48 is bonded to the rear surface of the rear plate 51*a* of the spacer 51 and located in front of the secondary cutting blade 61. The first thread seizing portion 35B provided on a lower portion of the distal end of the unit thread seizing member 33B has a front surface which is adapted to be brought into sliding contact with the second piled member 48'. FIGS. 25A and 25B, 26A and 26B and 27A and 27B illustrate manners of movement and swing of the unit thread seizing member 33A of the first thread seizing assembly 33 and manners of movement of the other thread seizing member 338 of the first thread seizing assembly 33. FIGS. 25A and 25B, 26A and 26B and 27A and 27B correspond to FIGS. 15A and 15B, 16A and 168 and 18A and 18B respectively.

Figure 25B:
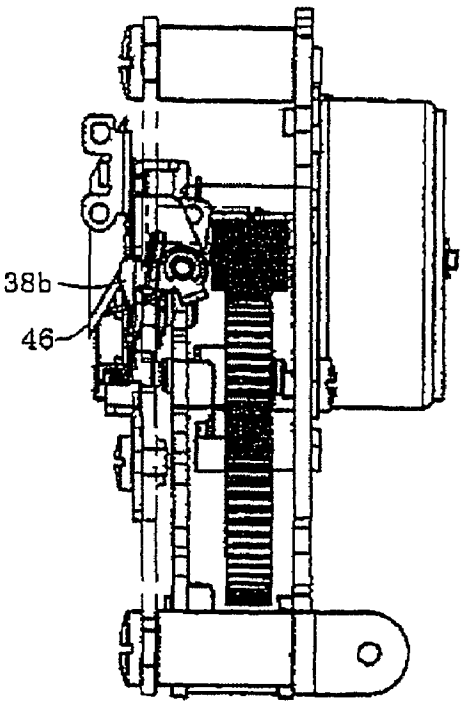
FIGS. 25A and 25B are views similar to FIGS. 15A and 15B respectively.
Figure 25A:
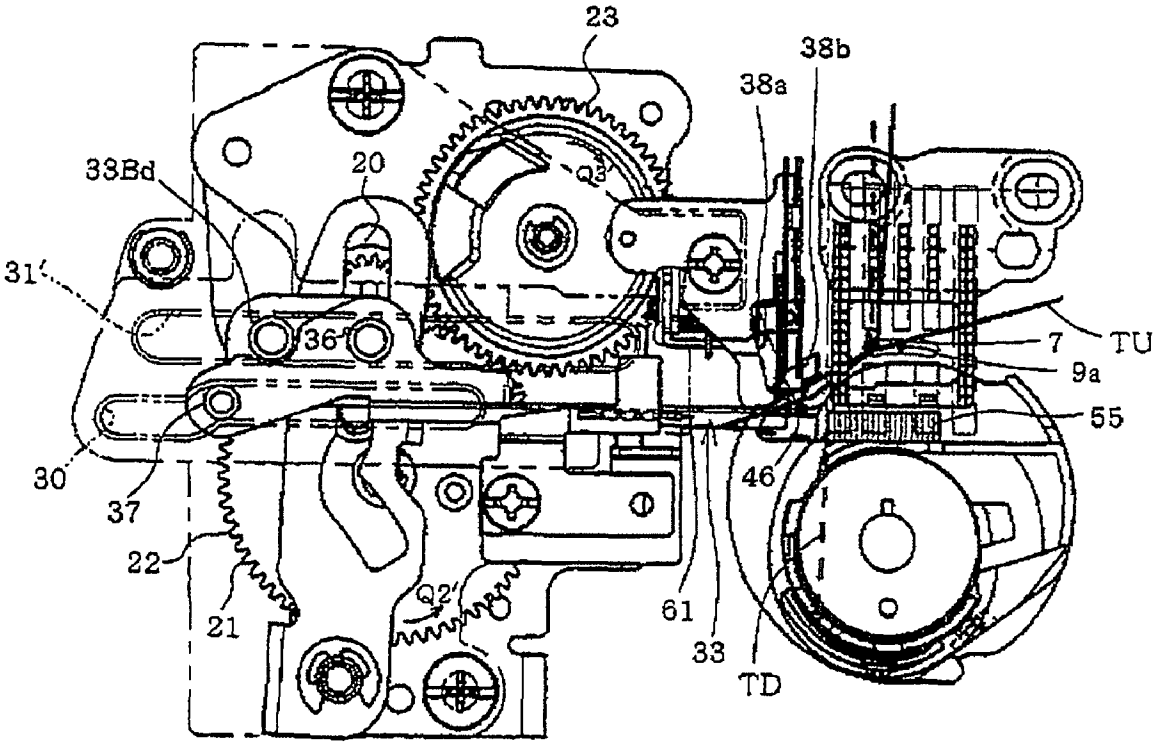
Figure 26B:
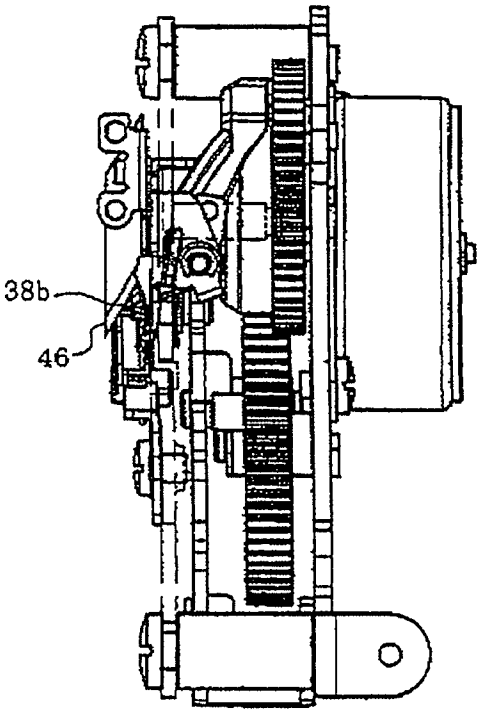
FIGS. 26A and 26B are views similar to FIGS. 16A and 16B respectively.
Figure 26A:
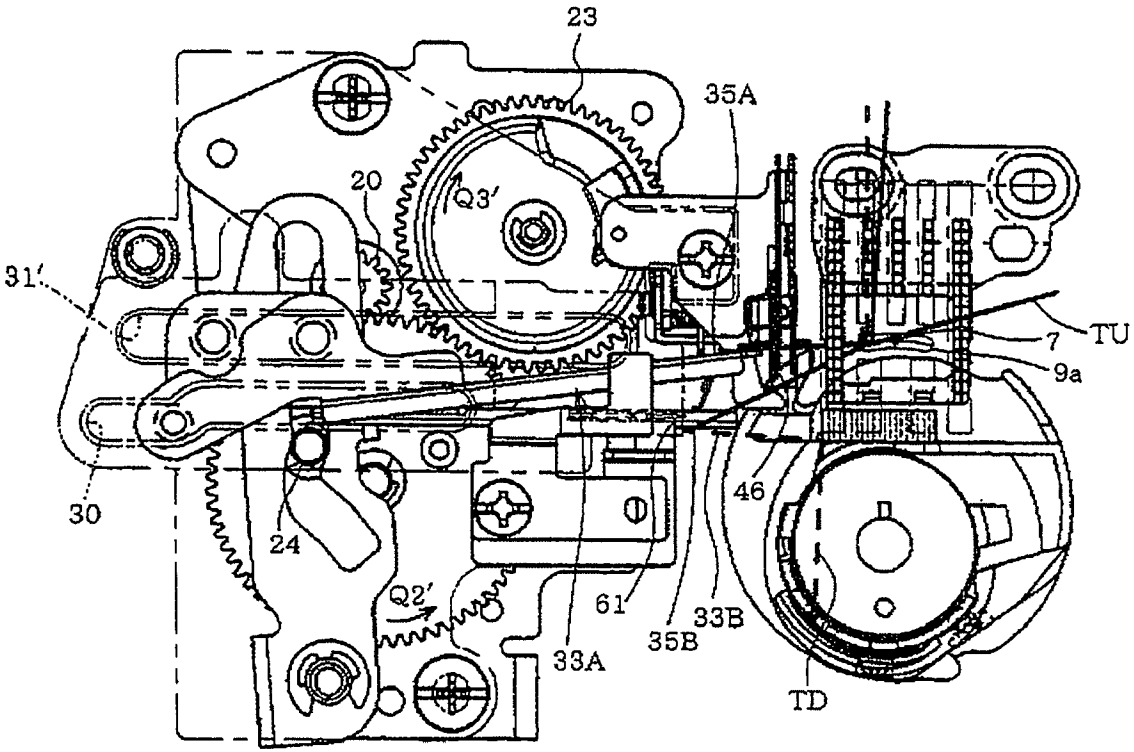
Figure 27B:
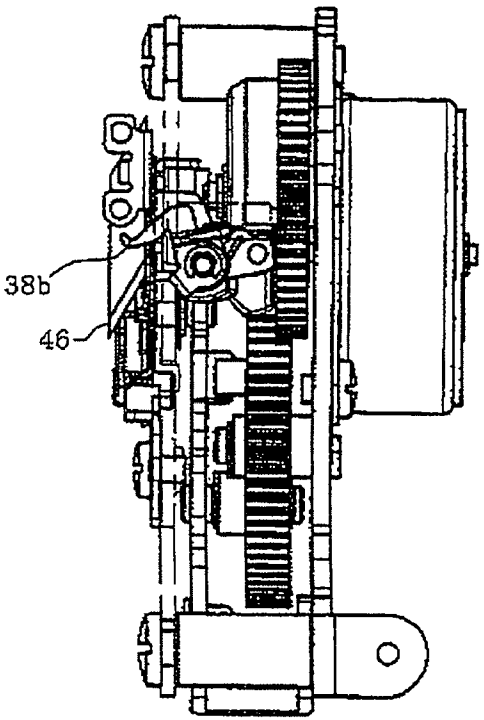
FIGS. 27A and 27B are views similar to FIGS. 18A and 18B respectively.
Figure 27A:
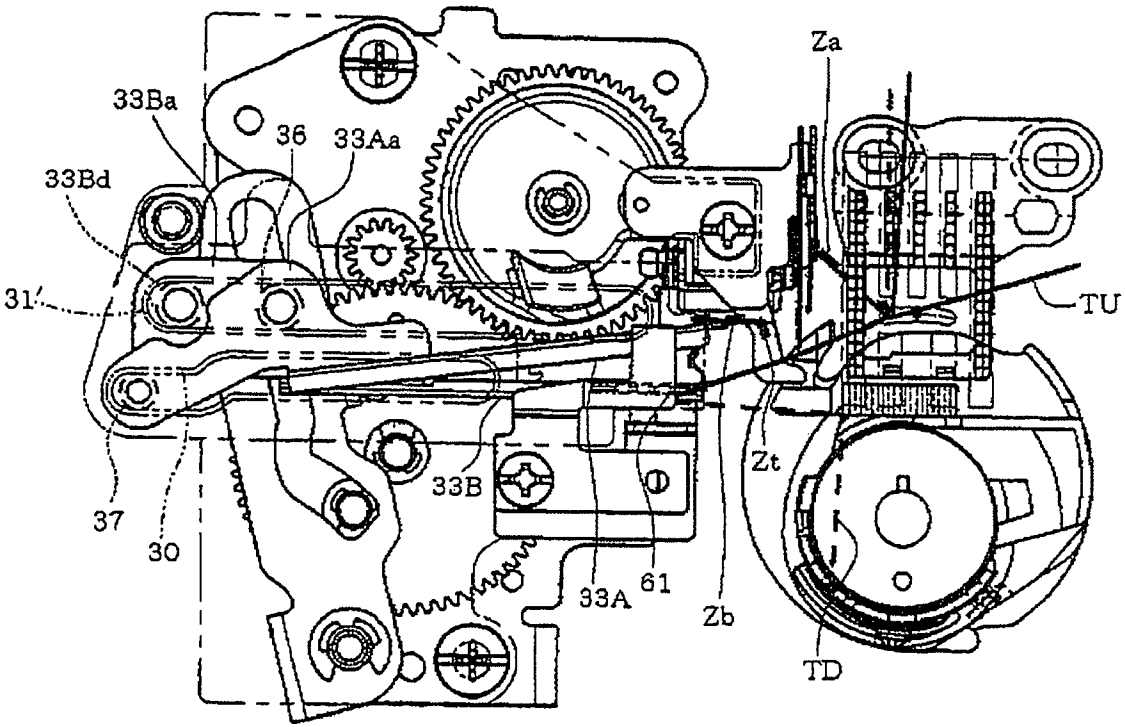

The needle and bobbin threads TU and TD are seized by the first thread seizing assembly 33 during the backward movement of the reciprocation of the first thread seizing assembly 33 as shown in FIG. 25A. The unit thread seizing member 33A is swung so as to come close to the second thread seizing assembly 38 as shown in FIG. 26A. The needle and bobbin threads TU and TD are cut in cooperation between the second thread seizing assembly 33 and the cutting blade 46 as shown in FIGS. 27A and 27B, whereupon the thread cutting is completed normally. Cut ends of the threads are designated by reference symbol "Zt" in FIG. 27A. The cut ends of the threads are also designated by reference symbol "Zt" in FIG. 29A. In this case, the needle and bobbin threads TU and TD are not tensioned after the needle and bobbin threads TU and TD have been cut. Accordingly, the relaxed needle and bobbin threads TU and TD are prevented from being cut by the secondary blade 61.

Figure 28B:
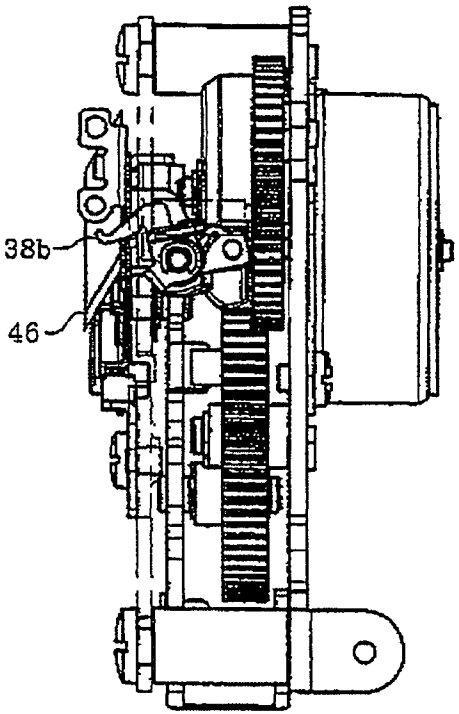
FIGS. 28A and 28B are views similar to FIGS. 18A and 18B, both showing the state where thread cutting has been carried out by an auxiliary cutting blade, respectively.
Figure 28A:
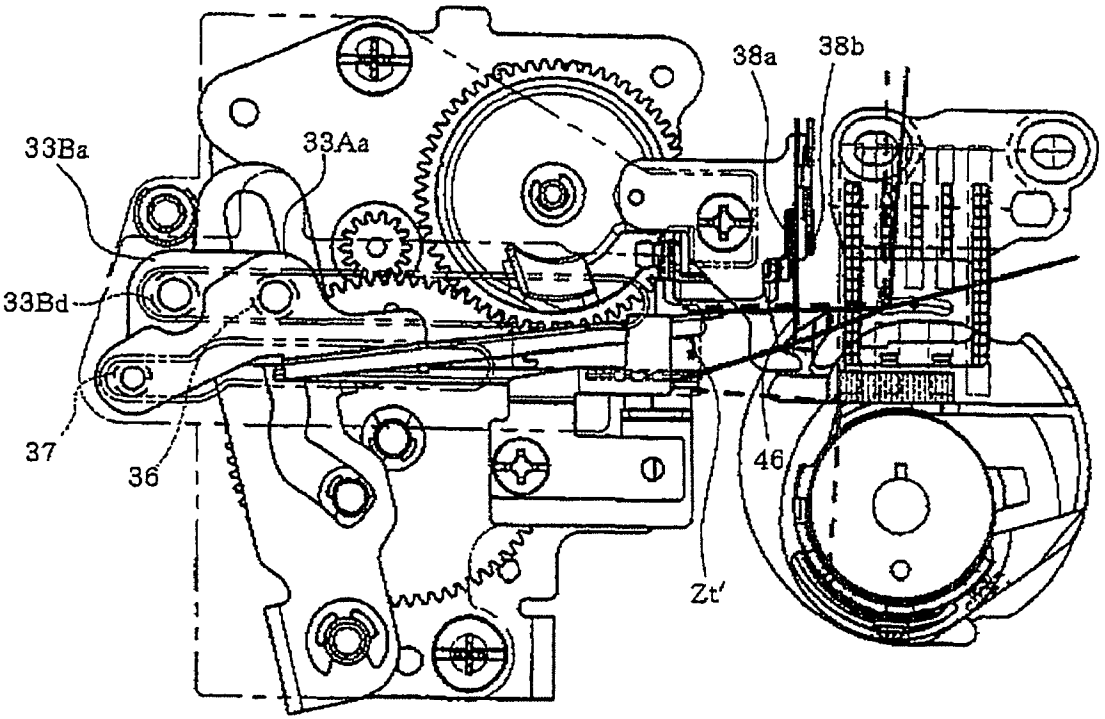
Figure 29A:
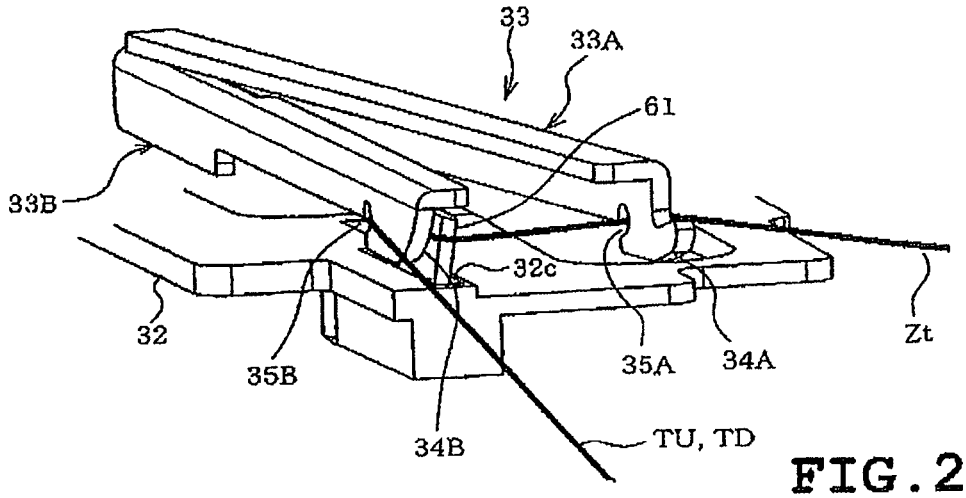
FIG. 29A is a perspective view of the auxiliary cutting blade and the first thread seizing assembly in a normal completed state.
Figure 29B:
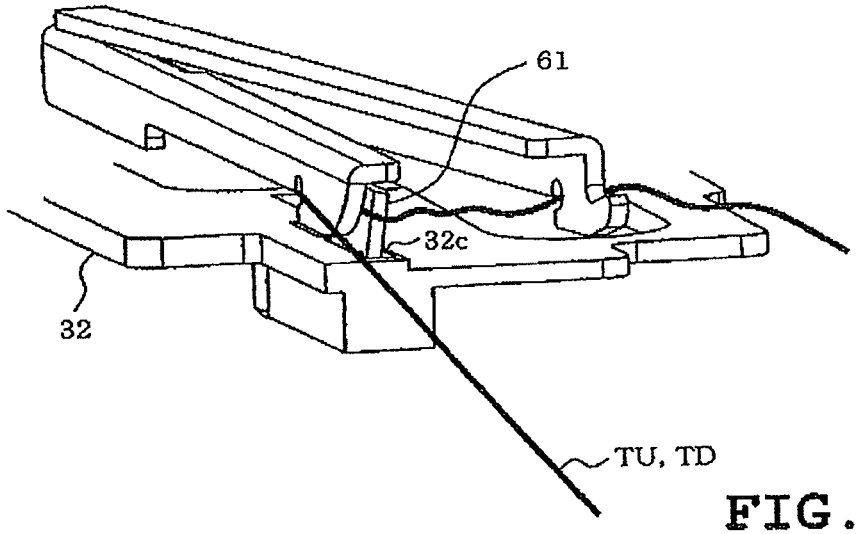
FIG. 29B is a perspective view of the auxiliary cutting blade and the first thread seizing assembly in the case where the thread seizure has not been carried out by the first thread seizing assembly.
Figure 29C:
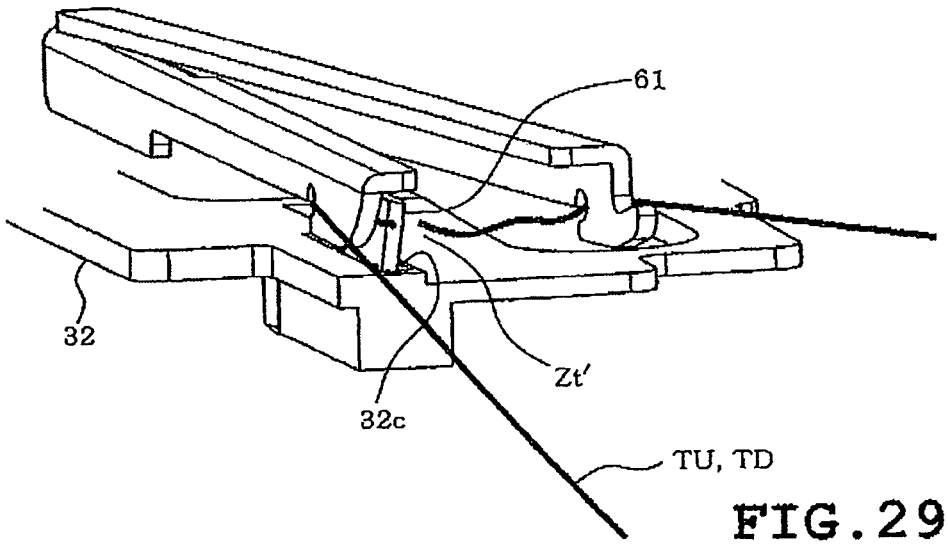
FIG. 29C is a perspective view of the auxiliary cutting blade and the first thread seizing assembly in the case where the needle and bobbin threads have been cut by the auxiliary cutting blade.

FIGS. 28A and 28B show the case where the needle and bobbin threads TU and TD are cut by the secondary blade 61 when the seizing of the needle and bobbin threads TU and TD by the second thread seizing assembly 38 has failed for some reasons. The cut ends of the needle and bobbin threads TU and TD are also designated by reference symbol "Zt'" in FIG. 29B. The needle and bobbin threads TU and TD are tensioned in the state as shown in FIG. 29B. Accordingly, when the first thread seizing assembly 33 is moved backward in the reciprocation, the needle and bobbin threads TU and TD are cut by the secondary cutting blade 61 as shown in FIG. 29C. Cut ends of the needle and bobbin threads TU and TD are designated by reference symbol. The needle thread TU at the needle 7 side and the bobbin thread TD at the bobbin 54 side are lightly held between the front side of the first thread seizing assembly 3513 and the second piled member 48'.

According to the second embodiment, the secondary cutting blade 61 is provided which cuts the needle and bobbin threads TU and TD seized by the first thread seizing assembly 33 at a predetermined location of the first thread seizing assembly 33 in the backward direction. Consequently, the needle and bobbin threads TU and TD can reliably be cut by the secondary cutting blade 61 even when the thread seizure by the second thread seizing assembly 38 has been incomplete such that the thread cutting has not been carried out by the cutting blade 46.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A thread cutter for a sewing machine, which is provided on an underside of a needle plate having a needle hole and cuts a needle thread and a bobbin thread both located between a workpiece cloth and a rotary hook including an outer rotating hook and an inner bobbin case, the thread cutter comprising:

a first thread seizing assembly which is supported so as to be reciprocally movable and includes two unit thread seizing members having distal ends provided with first thread seizing portions respectively, the first thread seizing assembly seizing the needle thread having passed the bobbin case and a bobbin thread by the first thread seizing portions, the bobbin case housing a bobbin on which a bobbin thread is wound, the bobbin thread extending from the bobbin to the needle hole of the needle plate;

a cutting blade located nearer to the needle hole side than a movement locus of the first thread seizing assembly;

a second thread seizing assembly which seizes the needle and bobbin threads both having been seized by the first thread seizing assembly during a backward movement of reciprocation of the first thread seizing assembly, cutting the needle and bobbin threads in cooperation with the cutting blade; and a drive unit which drives the first and second thread seizing assemblies, wherein when the needle and bobbin threads having been seized by the first thread seizing assembly are further seized by the second thread seizing assembly, the first thread seizing assembly is moved so that the distal ends of the unit thread seizing members are spaced from each other by a predetermined distance in a direction intersecting a movement direction of the first thread seizing assembly.

2. The thread cutter according to claim 1, wherein the distal ends of the unit thread seizing members are moved before the needle and bobbin threads are seized by the second thread seizing assembly.

3. The thread cutter according to claim 1, wherein at least one of the unit thread seizing members is movable while being swung.

4. The thread cutter according to claim 2, wherein when moved backward in the reciprocation, the first thread seizing assembly is swung so that the first thread seizing portions come close to the second thread seizing assembly.

5. The thread cutter according to claim 4, wherein when moved backward in the reciprocation, the first thread seizing assembly is swung so that one of the first thread seizing portions comes closed to the second thread seizing assembly.

6. The thread cutter according to claim 1, further comprising an auxiliary cutting blade which cuts the needle and bobbin threads both seized by the first thread seizing assembly, at a predetermined location in a direction of the backward movement of the first thread seizing assembly.

7. The thread cutter according to claim 1, wherein the first thread seizing assembly is held in a stopped state when the second thread seizing assembly is driven.

8. The thread cutter according to claim 1, wherein the second thread seizing assembly has a distal end on which a second thread seizing portion is provided, and the second thread seizing portion is two-forked so that the cutting blade is interposed between the two-forked portions.

9. The thread cutter according to claim 1, further comprising a thread cutting frame and a support shaft secured to the thread cutting frame, wherein the second thread seizing assembly is supported on the support shaft so as to be swingable.

10. The thread cutter according to claim 1, wherein the drive unit includes a single actuator and a drive mechanism driven by the actuator.

11. The thread cutter according to claim 10, wherein the drive mechanism includes a drive lever which drives the first thread seizing assembly, a drive pin which is rotated thereby to swing the drive lever and a cam which swings the second thread seizing assembly, the drive pin and the cam being driven by the actuator.

* * * * *